US011299938B2

(12) United States Patent
Quero et al.

(10) Patent No.: US 11,299,938 B2
(45) Date of Patent: Apr. 12, 2022

(54) WORKFLOW PROCESS FOR CONNECTING MULTIPLE COILED TUBING STRINGS

(71) Applicant: Halliburton Energy Services, Inc., Houston, TX (US)

(72) Inventors: Philippe Quero, Houston, TX (US); Eric Bivens, Littleton, CO (US); Robert Gordon Howard, Duncan, OK (US); Harley Jones, II, Duncan, OK (US); Peter Gainey, Houston, TX (US); Malcolm Richard, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/175,205

(22) Filed: Feb. 12, 2021

(65) Prior Publication Data

US 2021/0254412 A1 Aug. 19, 2021

Related U.S. Application Data

(60) Provisional application No. 62/975,970, filed on Feb. 13, 2020.

(51) Int. Cl.

| | |
|---|---|
| ***E21B 17/04*** | (2006.01) |
| ***E21B 17/20*** | (2006.01) |
| ***E21B 19/22*** | (2006.01) |
| ***E21B 17/06*** | (2006.01) |
| ***E21B 34/16*** | (2006.01) |
| ***E21B 33/047*** | (2006.01) |
| ***E21B 33/12*** | (2006.01) |

(52) U.S. Cl.

CPC ..... *E21B 17/041* (2020.05); *E21B 17/06* (2013.01); *E21B 17/20* (2013.01); *E21B 19/22* (2013.01); *E21B 33/047* (2013.01); *E21B 33/12* (2013.01); *E21B 34/16* (2013.01)

(58) Field of Classification Search

CPC ..... E21B 17/02; E21B 17/04; E21B 17/041; E21B 17/06; E21B 17/20; E21B 19/22; E21B 33/047

See application file for complete search history.

(56) References Cited

U.S. PATENT DOCUMENTS 6,161,619 A * 12/2000 Head ..... E21B 17/015 166/355
6,264,244 B1 * 7/2001 Isennock ..... E21B 17/02 285/55

(Continued)

FOREIGN PATENT DOCUMENTS

CN 205977138 U 2/2017
WO 0159250 A1 8/2001

*Primary Examiner* — Matthew R Buck
(74) *Attorney, Agent, or Firm* — Thomas Rooney; Parker Justiss, P.C.

(57) ABSTRACT

Provided is a method for connecting coiled tubing strings, as well as a flexible stabbing snake. In one aspect, the method for connecting coiled tubing strings includes lowering a downhole end of a first coiled tubing string within a wellbore, and coupling an uphole end of the first coiled tubing string to a downhole end of a second coiled tubing string at a location between a coiled tubing injector and the wellbore to form a combined coiled tubing string. In at least one aspect, the method further includes lowering the combined coiled tubing string within the wellbore.

19 Claims, 17 Drawing Sheets

(56) References Cited

U.S. PATENT DOCUMENTS

| | | | | |
|---|---|---|---|---|
| 6,367,557 | B1 * | 4/2002 | Rosine | E21B 19/22 166/384 |
| 7,237,809 | B2 * | 7/2007 | Connell | E21B 17/04 285/256 |
| 7,677,302 | B2 * | 3/2010 | Ehtesham | E21B 17/20 166/77.2 |
| 9,453,376 | B1 * | 9/2016 | Raymond | E21B 17/20 |
| 2008/0073085 | A1 * | 3/2008 | Lovell | E21B 17/04 166/377 |
| 2014/0311754 | A1 * | 10/2014 | Misselbrook | E21B 17/04 166/380 |
| 2016/0186507 | A1 | 6/2016 | Varkey | |
| 2018/0112473 | A1 * | 4/2018 | Howell, Sr | F16L 27/04 |
| 2020/0224503 | A1 * | 7/2020 | De Lemos Junior | E21B 17/015 |

* cited by examiner

WORKFLOW PROCESS FOR CONNECTING MULTIPLE COILED TUBING STRINGS

CROSS-REFERENCE TO RELATED APPLICATION

This application claims the benefit of U.S. Provisional Application Ser. No. 62/975,970, filed on Feb. 13, 2020, entitled "WORKFLOW PROCESS FOR CONNECTING MULTIPLE COILED TUBING STRINGS," commonly assigned with this application and incorporated herein by reference in its entirety.

BACKGROUND

Coiled or spoolable tubing is commonly used in various oil and gas operations, which include drilling of wellbores, work over operations, completion operations and production operations, among others A coiled tubing is a continuous tubing that is spooled on a reel as a conveying device for one or more downhole tools. An injector is typically used to run the coiled tubing into and out of the wellbore. For chilling, a bottom hole assembly carrying a drill bit at its bottom (downhole) end may be attached to the coiled tubing's bottom end. The coiled tubing is hollow or has a through passage, which acts as a conduit for the drilling and process fluid to be supplied downhole under pressure from the surface. For completion and workover operations, the coiled tubing may be used to convey one or more devices into and/or out of the wellbore.

BRIEF DESCRIPTION

Reference is now made to the following descriptions taken in conjunction with the accompanying drawings, in which.

DETAILED DESCRIPTION

Figure 1:
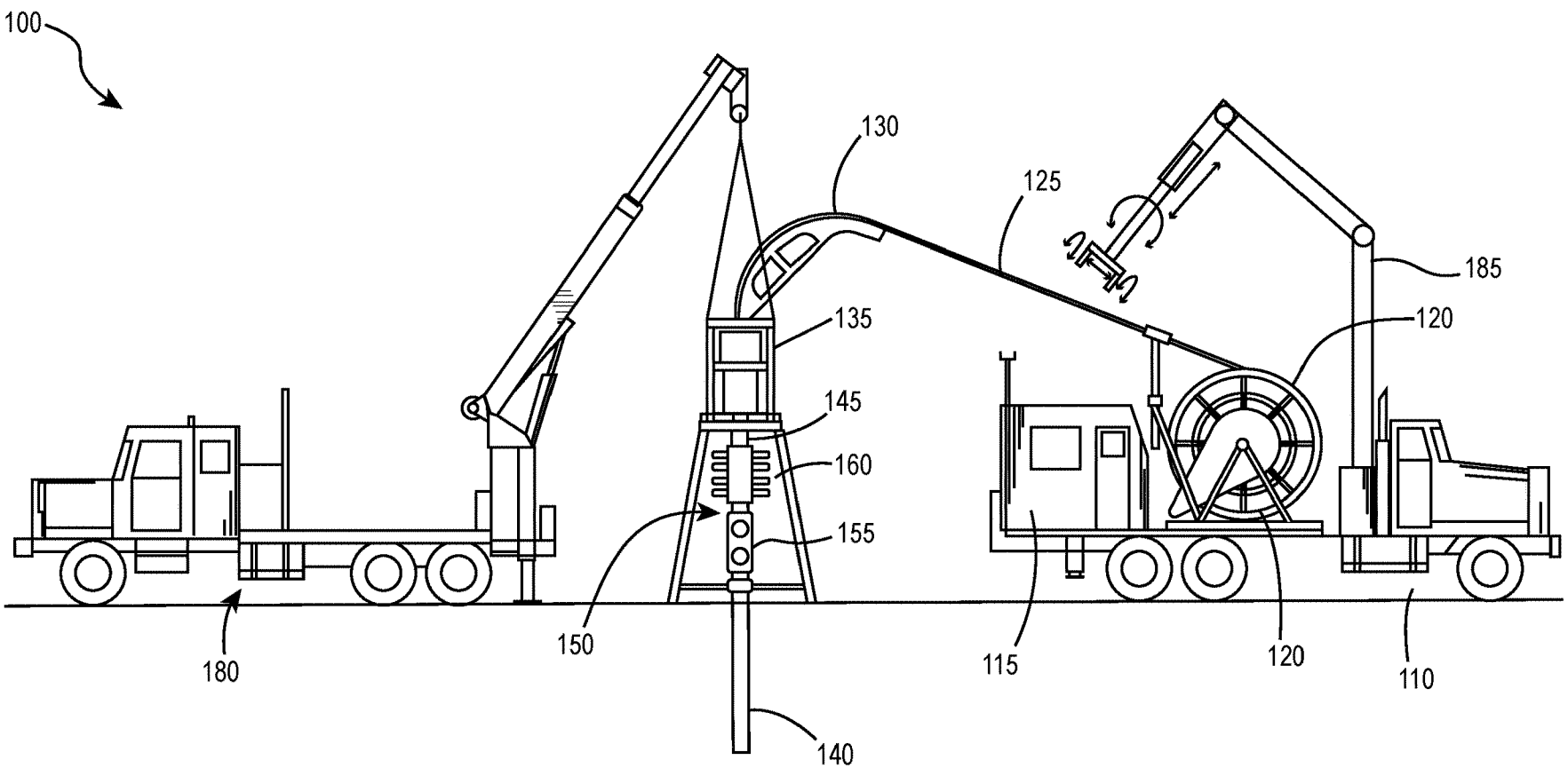
FIG. 1 illustrates a coiled tubing surface equipment spread for running coiled tubing, the coiled tubing surface equipment spread designed, manufactured and operated according to the disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles, aspects or embodiments of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The global trend sees wells increasing in length, especially lateral length (e.g., upwards of about 12,200 meters measured depths). Accordingly, some operators are drilling wells they know cannot be accessed by conventional light intervention methods. Current light intervention methods are limited to the maximum reach capability of coiled tubing, based on the maximum length of tubing that can be combined on a single spool. The spool capacity is often capped by the maximum transport load of a trailer, the maximum lift capacity of a crane, rigging space limitations, and/or simply the size of the available reels.

Some methods use combined jointed pipe and coiled tubing to extend the workable reach of a coiled tubing string, which may involve two separate pipe handling and drive mechanisms, thereby increasing the amount of surface equipment and job skills required on surface. Aspects of the present disclosure include a safe, reliable, fast connecting system that can join two coiled tubing strings from two different reels together. In certain embodiments, the two coiled tubing strings are joined together between the injector and the wellhead stack. For example, in at least one embodiment, the two coiled tubing strings are joined together in a work/access window positioned downhole of the injector, with a flexible stabbing/deployment/retrieval device (hereinafter, "flexible stabbing snake") to aid with alternating between coiled tubing reels/strings. In yet another embodiment, the two coiled tubing strings are joined together uphole of the coiled tubing injector, for example between the coiled tubing injector and the coiled tubing reels containing the two coiled tubing strings. A system according to this disclosure may, in one aspect, be used to connect sections of coiled tubing having the same outer diameter (OD) and inner diameter (ID), as well as sections having different ODs and/or IDs.

A proposed method, for example, may deploy multiple coiled tubing strings, of the same or differing OD and wall thickness, into a wellbore by combining them in sequence/series into a combined coiled tubing string, thus extending the reach of the combined coiled tubing string beyond the limit of an individual coiled tubing string, and thus exceed the limitations of the capacity of a single spool of coiled tubing. This workflow may employ a single injector set-up with a pressure containing or non-pressure containing work window for making and breaking the connections between multiple coiled tubing strings. The different coiled tubing reels can have a spoolable/pre-installed (e.g., dimple-on, roll-on, high pressure flexible hose or temporary connector fastened to the coiled tubing in any manner) connector at or near the end of the base wrap and/or at/near the whip end of their respective cool tubing strings, which are either connected or removed prior to connecting the coiled tubing strings in the work window that may be secured on the blowout preventer/wellhead stack, after securing the coiled tubing and containing well pressure. A stabbing snake may be used in certain embodiments to facilitate deployment/retrieval of either of the coiled tubing strings through the injector and into the well. Telescopic/articulated tubing handling equipment may also be used to manage tubing movement prior to landing both strings in the work window.

This method may be used to expand the range of service capability for coiled tubing applications on offshore or onshore platforms with limited rigging space or limited crane capacity. For example, the method may enable the use of multiple (e.g., two, three, four or more) smaller coiled tubing strings rather than a single large string. As a benefit over methods utilizing jointed pipe and coiled tubing, the same equipment may be used to deploy all sections of the coiled tubing strings, as opposed to needing separate sets of pipe handling equipment. The operator qualifications are consistent throughout the operation, and no procedural variances or other operating considerations are needed between the different sections of the coiled tubing strings, thus improving the overall safety and efficiency of the operation. Moreover, this method will allow current generation surface equipment to remain viable for servicing super extended reach wells, and provide additional work scope capabilities for coiled tubing strings in work environments with limited deck space and/or crane lift capacities. This disclosure specifies a unique method to address this problem by employing only coiled tubing (e.g., no jointed pipe) in one embodiment to access these hard to reach areas, all the while expediting the drilling process.

FIG. 1 illustrates a coiled tubing surface equipment spread 100 for running coiled tubing, the coiled tubing surface equipment spread designed, manufactured and operated according to the disclosure. In at least one embodiment, the coiled tubing surface equipment spread includes a truck 110, a wellhead stack 150, and a crane truck 180. In the illustrated embodiment, the truck 110 (e.g., coiled tubing truck) carries behind its cab a power pack including a hook-up to the truck motor or power take off, hydraulic pumps and an air compressor. The coiled tubing injecting operation can be run from the control cab 115 located at the rear of truck 110. Control cab 115 may comprise the operational center. Reel 120 comprises the spool that carries the coiled tubing string to/at the job site. Reel 120 is often limited in its outside spool diameter so that, with a full load of coiled tubing wound thereon, the reel can be trucked over the highways or waterway and to a job site.

FIG. 1 additionally illustrates coiled tubing string 125 passed over a coiled tubing guide arch 130 (e.g., gooseneck guide) and inserted into a wellbore 140 using a coiled tubing injector 135. Coiled tubing injector 135 often involves two hydraulic motors and two counter-rotating chains by means of which the coiled tubing injector 135 grips the coiled tubing string 125 and spools or unspools the coiled tubing string 125 to and from the reel 120. Coiled tubing stripper 145 provides a pressure barrier between coiled tubing string 125 and the wellbore 140. The wellhead stack 150 is illustrated as having a typical well Christmas tree 155 and blowout preventer 160. The crane truck 180 provides lifting means for working at the well site.

FIG. 1 further illustrates telescopic/articulated pipe handling equipment 185 designed, manufactured and operated according to the disclosure. The telescopic/articulated pipe handling equipment 185 is illustrated as being coupled to the truck 110, but it could easily be attached to the crane truck 180 or be deployed as its own standalone device (e.g., truck, tractor, etc.). The telescopic/articulated pipe handling equipment 185 may have free range of motion so as to grip, position, and re-position coiled tubing string wherever it may need to be placed within a large radius around the coiled tubing equipment surface spread 100. The telescopic/articulated pipe handling equipment 185 may include one or more separate articulating arms. Note that in some examples the telescopic/articulated pipe handling equipment 185 may be replaced by an additional crane unit to secure/position the coiled tubing string, or even with a series of tubing clamps and guide lines handled by ground personnel.

Figure 2:
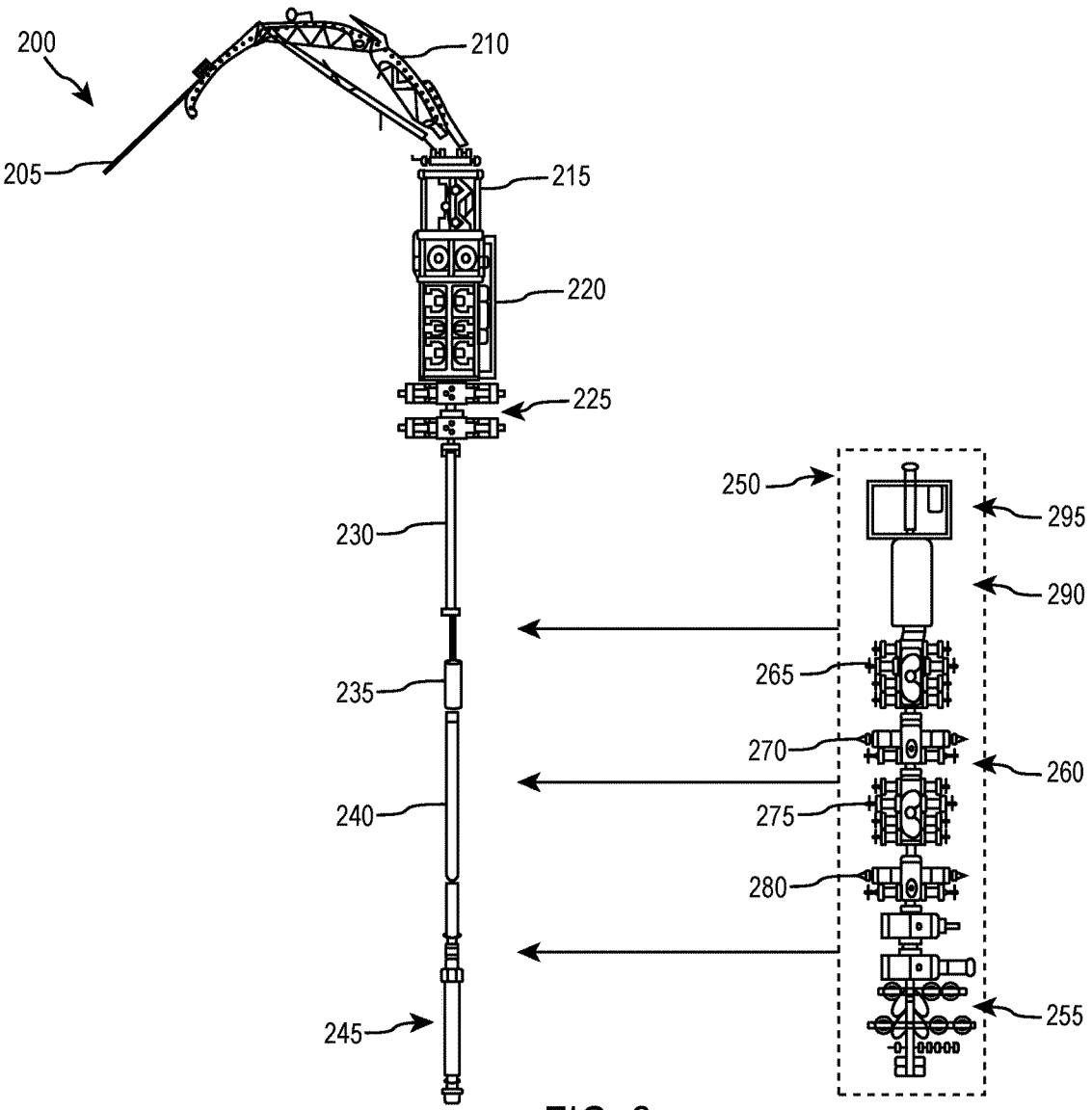
FIG. 2 illustrates elements of a coiled tubing surface equipment spread and downhole assembly designed, manufactured and operated according to the disclosure.

FIG. 2 illustrates elements of a coiled tubing surface equipment spread and downhole assembly 200 designed, manufactured and operated according to the disclosure. In accordance with the disclosure, the coiled tubing surface equipment spread and downhole assembly 200 includes key components added to enable the deployment of multiple coiled tubing strings as a combined workstring. In the illustrated embodiment, the coiled tubing surface equipment spread and downhole assembly 200 is positioned proximate, if not partially within, a wellhead stack 250. The wellhead stack 250, in at least one embodiment, includes a typical well Christmas tree 255, a primary well control stack 260, an annular blow out preventer (BOP) 290, and an optional work window 295. In at least one embodiment, such as that shown, the primary well control stack 260 includes a first quad BOP 270 for a first coiled tubing string size, a first dual combi BOP 275 for the first coiled tubing string size, a second quad BOP 280 for a second coiled tubing string size, and a second dual combi BOP 285 for the second coiled tubing string size. To the extent a single size coiled tubing string (e.g., single outer diameter coiled tubing string) is used for the first and second reels, the primary well control stack 260 could employ just the first quad BOP 270 and the first dual combi BOP 275.

In the illustrated embodiment, the coiled tubing surface equipment spread and downhole assembly 200 additionally includes coiled tubing string 205 extending over a coiled tubing guide arch 210 and into the wellhead stack 250. The coiled tubing surface equipment spread and downhole assembly 200 additionally includes an optional pipe straightener 215, as well as a coiled tubing injector 220 for injecting the coiled tubing 205 into the wellhead stack 250. In at least one embodiment, the coiled tubing surface equipment spread and downhole assembly 200 employs only a single injector set-up. The coiled tubing surface equipment spread and downhole assembly 200 may additionally include one or more coiled tubing strippers 225. The example shown uses a set of ram type stripper assemblies (though over under, annular, ram type "sidewinder" strippers and/or any combination of strippers may be used) to allow an annular seal to be maintained while moving the work-string in/out of the well in a live well scenario. A sidewinder stripper may be substituted with a set of stripping rams from a hydraulic work-over unit or annular blowout preventers to enable the same capability while still accommodating multiple ODs. In the illustrated embodiment, the coiled tubing surface equipment spread and downhole assembly 200 includes two coiled tubing strippers 225 (e.g., one for each size of coiled tubing string). However, other embodiments may exist wherein a single coiled tubing stripper 225 is used, for example if a single size outer diameter coiled tubing string is used for the first and second reels. In the illustrated embodiment, the coiled tubing surface equipment spread and downhole assembly 200 additionally includes a lubricator 230, a connector 235, an optional trip-out safety valve 240, and a bottom hole assembly (BHA) 245. In at least one embodiment, the BHA 245 is a milling assembly coupled to a downhole end of the coiled tubing 205.

Figure 3:
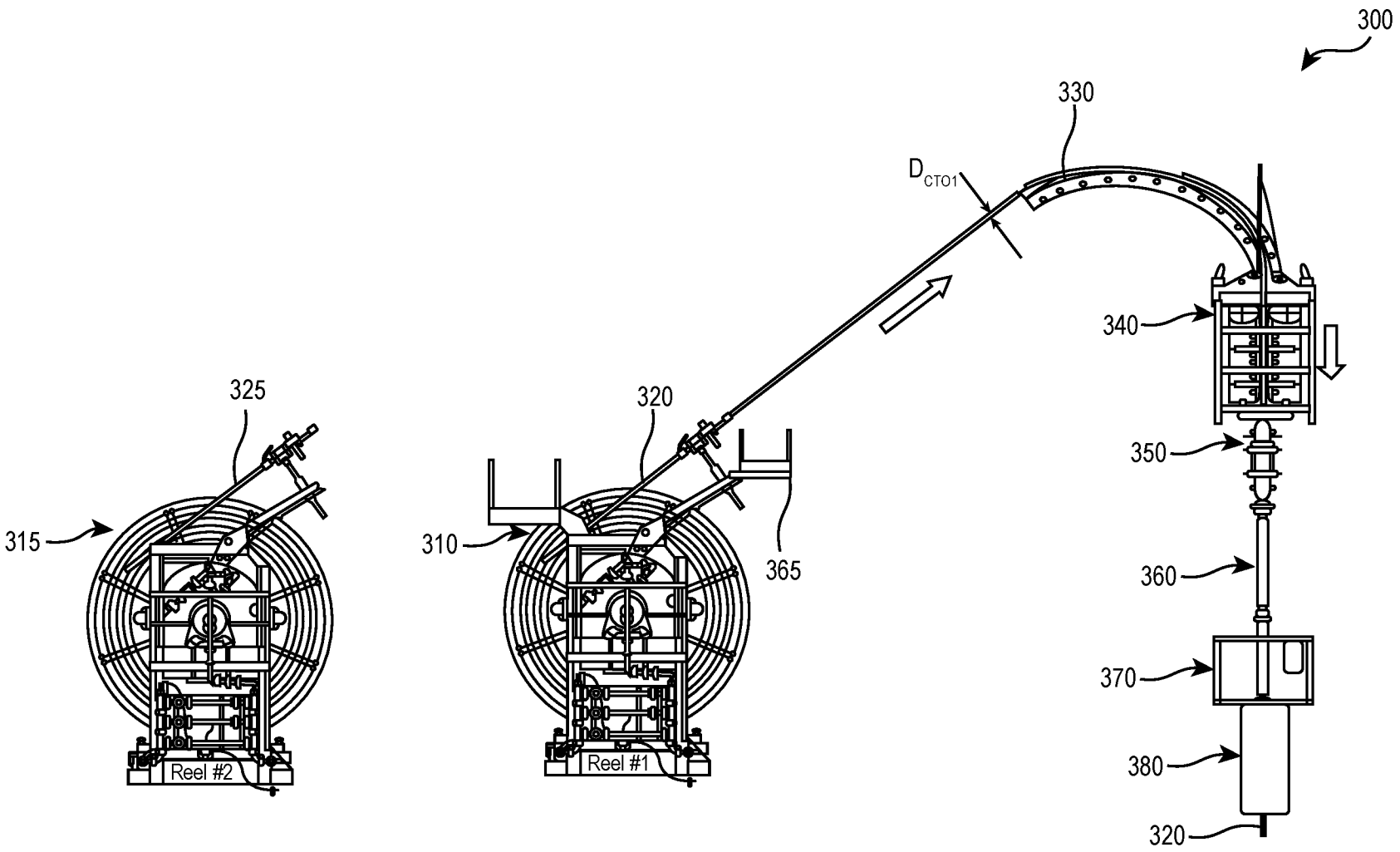
FIGS. 3 through 14 illustrate a method for connecting coiling tubing strings in accordance with one or more embodiments of the disclosure.

FIGS. 3 through 16 illustrate a method for connecting coiling tubing strings in accordance with one or more embodiments of the disclosure. With initial reference to FIG. 3, illustrated is one embodiment of a workflow 300 method for connecting coiled tubing strings designed, manufactured and operated according to one or more embodiments of the disclosure. The workflow 300 illustrated in FIG. 3 initially includes a first coiled tubing reel 310. In at least one embodiment, as shown, the first coiled tubing reel 310 includes a first coiled tubing string 320 placed thereon. In at least one embodiment, the first coiled tubing string 320 is wound around the first coiled tubing reel 310. The first coiled tubing string 320 may comprise many different coiled tubing types and sizes and remain within the purview of the disclosure. Nevertheless, in at least one embodiment, the first coiled tubing string 320 has a first coiled tubing outside diameter ($D_{CTO1}$) as well as a first coiled tubing inside diameter ($D_{CTI1}$).

The workflow 300 illustrated in FIG. 3 additionally includes a second coiled tubing reel 315. In at least one embodiment, as shown, the second coiled tubing reel 315 includes a second coiled tubing string 325 placed thereon. In at least one embodiment, the second coiled tubing string 325 is wound around the second coiled tubing reel 315. The second coiled tubing string 325 may comprise many different coiled tubing types and sizes and remain within the purview of the disclosure. Nevertheless, in at least one embodiment, the second coiled tubing string 325 has a second coiled tubing outside diameter ($D_{CTO2}$) as well as a second coiled tubing inside diameter ($D_{CTI1}$). In at least one embodiment, the second coiled tubing outside diameter ($D_{CTO2}$) is greater than the first coiled tubing outside diameter ($D_{CTO1}$). In other embodiments, the opposite may be true, or alternatively the second coiled tubing outside diameter ($D_{CTO2}$) and the first coiled tubing outside diameter ($D_{CTO1}$) are the same.

The workflow 300 illustrated in FIG. 3 additionally includes a coiled tubing guide arch 330, which in the embodiment illustrated is coupled to a coiled tubing injector 340. The coiled tubing guide arch 330 and the coiled tubing injector 340 may be any guide arch or coiled tubing injector currently known or hereafter discovered without departing from the present disclosure. Coupled to the coiled tubing injector 340, in the illustrated embodiment, is a coiled tubing stripper 350. In the illustrated embodiment, a single coiled tubing stripper 350 is employed. Nevertheless, in other embodiments, two or more coiled tubing strippers 350 may be used, for example in situations wherein the second coiled tubing outside diameter ($D_{CTO2}$) is greater than the first coiled tubing outside diameter ($D_{CTO1}$). In at least one embodiment, a lubricator and/or riser 360 is coupled downhole of the coiled tubing stripper 350.

The workflow 300 illustrated in FIG. 3 additionally includes an optional work window 370. The work window 370, in one or more embodiments, provides a pressure containing or non-pressure containing enclosure for accessing certain features of the workflow, including one or both of the first coiled tubing string 310 and/or the second coiled tubing string 315. Positioned below the work window 370, in the illustrated embodiment, is a BOP 380.

The workflow 300 illustrated in FIG. 3 is configured as if it were just rigged up, and thus the first coiled tubing reel 310 is substantially full of the first coiled tubing string 320. The workflow 300 of FIG. 3 begins with an operator rigging up the coiled tubing guide arch 330, the coiled tubing injector 340, the coiled tubing stripper 350, and the lubricator and/or riser 360, in addition to any other components that might be required (e.g., work window 370 and/or BOP 380). The operator may then run a downhole end of the first coiled tubing string 320 over the coiled tubing guide arch 330, and then stab the downhole end of the first coiled tubing string 320 into the coiled tubing injector 340, the coiled tubing stripper 350, and the lubricator 360. With the downhole end of the first coiled tubing string 320 stabbed into the coiled tubing injector 340, and the coiled tubing stripper 350, a crane (not shown) may raise the items, as per normal coiled tubing rigging methods. Typically these items are ultimately lifted and held in place with the help of a crane (not shown), but other lifting means are within the scope of the disclosure.

Thereafter, the operator may run the first coiled tubing string 320 down to ground level and assemble a BHA to the end thereof, for example starting with a premium connector. Subsequent thereto, the operator may add any remaining BHA components, for example considering a power reach trip-in safety valve as DFCV back-up. Then, the operator may rig up the coiled tubing injector 340 to the wellhead stack (not shown) as per normal coiled tubing rigging methods, secure the wellhead stack, run a pressure test, equalize and then open the well. With the workflow 300 in place, and the pressure test complete, the first coiled tubing string 320 may be lowered (e.g., run) into the wellbore, for example using the coiled tubing injector 340, until only a few last wraps of the first coiled tubing string 320 remain on the first coiled tubing reel 310.

Figure 4:
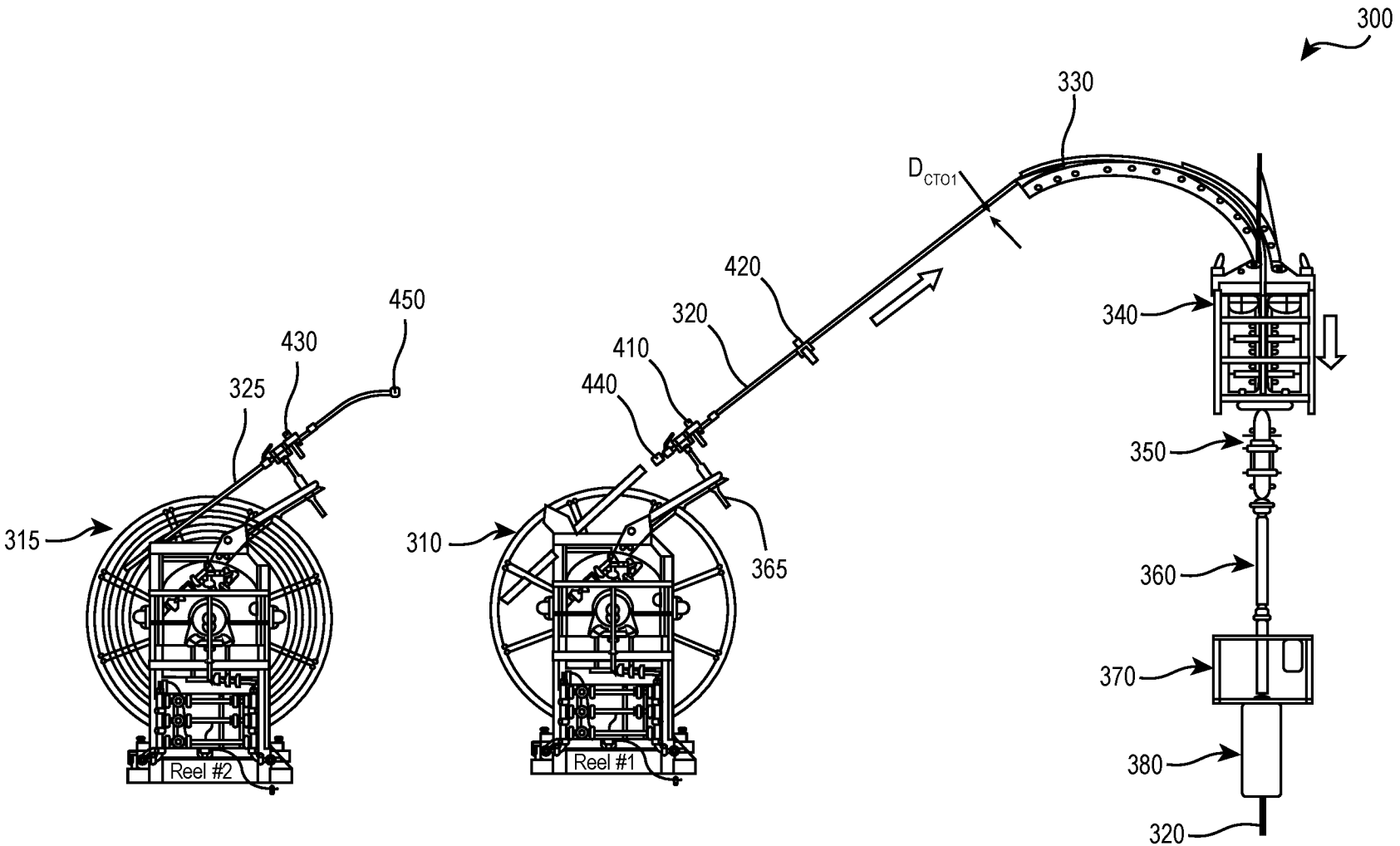

Turning to FIG. 4, the workflow 300 might continue with the operator stopping displacement of the first coiled tubing string 320 when no more wraps of the first coiled tubing string 320 remain around the first coiled tubing reel 310. Thereafter, the operator could monitor/ensure that the check valves at the BHA are holding well pressure, and then the operator could close the slip/seal rams in the BOP 380, and then bleed-off the pressure from the first coiled tubing string 320. In scenarios where the first coiled tubing string 320 in the wellbore cannot be bled to 0 psi (e.g., due to collapse risk), a solidifying gel plug or plug type check valve may be circulated into the first coiled tubing string 320 to create a pressure barrier below the break point/near surface. A freeze plug could also be applied if needed. Then, the operator could in one or more embodiments secure the first coiled tubing string 320 in place with a hydraulically actuated mechanical arm 365 connected to the first coiled tubing reel 310, for example between the drum of the first coiled tubing reel 310 and the level wind. The operator could then disconnect the uphole end of the first coiled tubing string 320 from the first coiled tubing reel 310.

The workflow 300 of FIG. 4 additionally includes one or more clamps 410, 420 coupled to the first coiled tubing string 320. The one or more clamps 410, 420 assist in supporting the first coiled tubing string 320. For example, the one or more clamps 410, 420 may be used to prevent the first coiled tubing string 320 from moving into or out of the wellbore while the first coiled tubing string 320 is no longer coupled to the first coiled tubing reel 310. The workflow 300 of FIG. 4 may additionally include one or more second clamps 430 coupled to the second coiled tubing string 325. The one or more second clamps 430 assist in supporting the second coiled tubing string 325.

The workflow 300 illustrated in FIG. 4 may additionally include, in at least one embodiment, a first working connector 440 (e.g., a first pre-installed working connector) coupled to the uphole end of the first coiled tubing string 320, and a second working connector 450 (e.g., second pre-installed working connector) coupled to the downhole end of the second coiled tubing string 325. While the first working connector 440 and the second working connector 450 provide ease in coupling and/or decoupling the first and second coiled tubing strings 320, 325 from related items, in an alternative example, the first and second working connectors 440, 450, are eliminated, and the coiled tubing could be cut and outfitted with a temporary connector in the field.

Figure 4A:
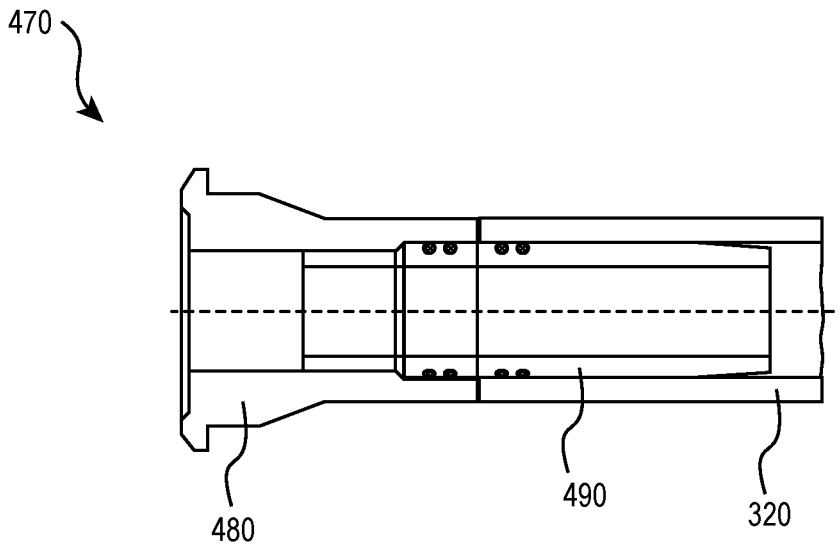
Figure 4B:
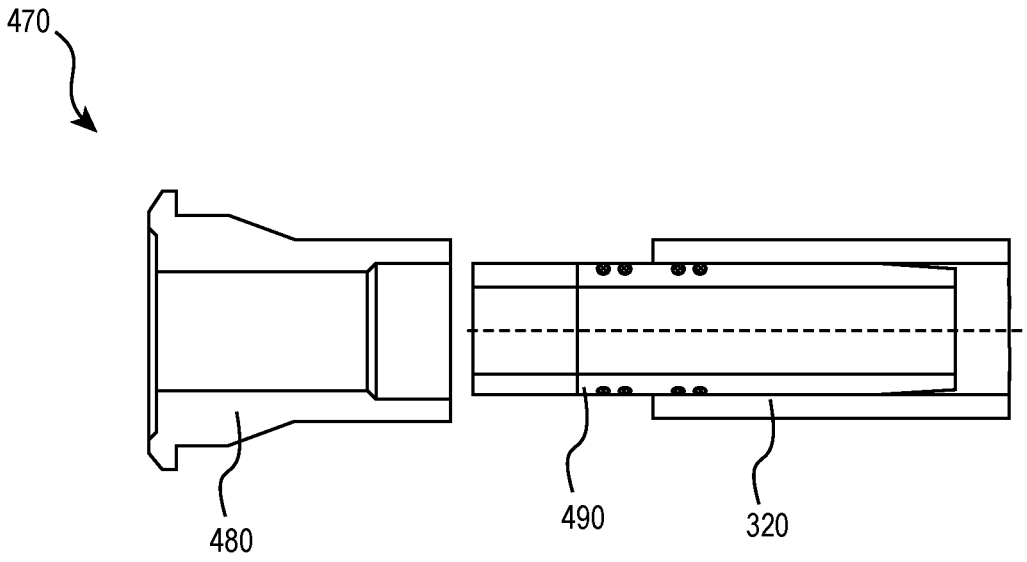

Turning briefly to FIGS. 4A and 4B, with continued reference to FIG. 4, illustrated is one embodiment of a connection 470 between the first coiled tubing reel 310 and an uphole end of the first coiled tubing string 320. FIG. 4A illustrates the connection 470 in a connected state, whereas FIG. 4B illustrates the connection 470 in a disconnected state. In the illustrated embodiment of FIGS. 4A and 4B, the connection 470 includes a reel connector nut 480 coupled to the first coiled tubing reel 310, as well as a connector insert 490 positioned partially within the uphole end of the first coiled tubing string 320. In the illustrated embodiment, the reel connector nut 480 removable engages with the connector insert 490 to couple the first coiled tubing reel 310 and the uphole end of the first coiled tubing string 320. While the embodiment of FIGS. 4A and 4B illustrate the connection 470 as a reel connector nut 480 and a connector insert 490, other embodiments exist employing a hammer union connection (e.g., at the modified 1502 hammer union) on the first coiled tubing reel 310. Thus, the workflow 300 is not limited to the use of a reel connector nut 480 or a hammer union, as other connection types may be employed as alternatives.

In certain embodiments, the workflow 300 requires getting into the first coiled tubing reel 310 for making and breaking the connection 470. In other examples, however, the first coiled tubing reel 310 might have a coiled tubing pigtail or other similar extension that extends radially outside the first coiled tubing reel 310 when the first coiled tubing string 320 is no longer wound around the first coiled tubing reel 310. In at least one embodiment, the coiled tubing pigtail extends the connection 470 by up to about 30.5 meters (e.g., up to about 100 feet), and for example past the hydraulically actuated mechanical arm. In this embodiment, the connection 470 would be radially outside of the first coiled tubing reel 310, and thus rendering it easier to make and/or break the connection 470. In at least one embodiment, the connection 470 can be installed by the coiled tubing string manufacturer. In this case, the first coiled tubing reel 310 may be modified to have a flat or recessed area to accommodate the straight rigid connector without bending it significantly.

Figure 5:
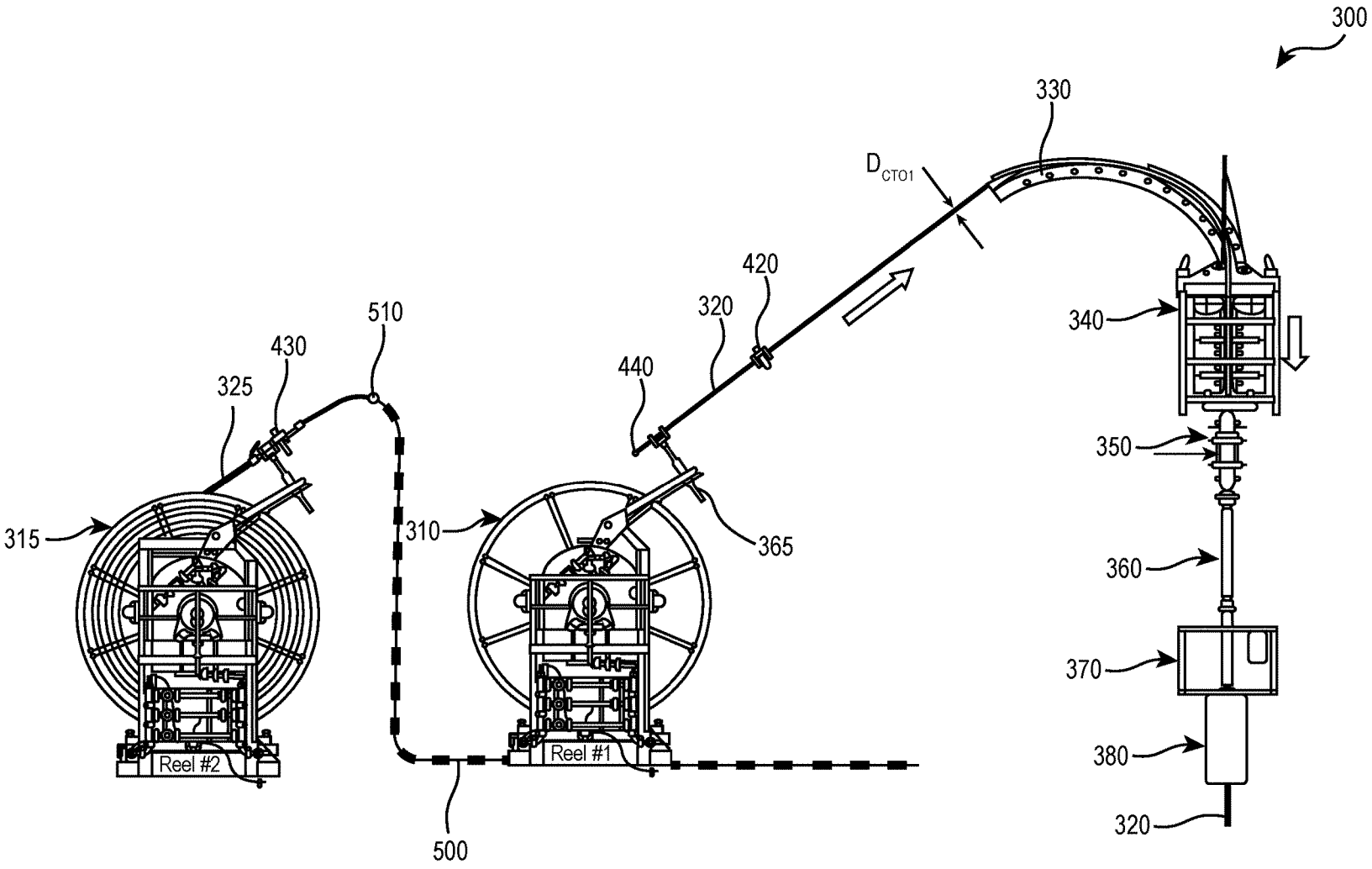

Turning to FIG. 5, the workflow 300 continues with the operator connecting the downhole end of the second coiled tubing string 325 to an uphole end of a flexible stabbing snake 500. Accordingly, a second junction 510 is formed between the two. In one or more embodiments, the flexible stabbing snake 500 may be coupled with the second working connector 450 (FIG. 4).

Figure 6:
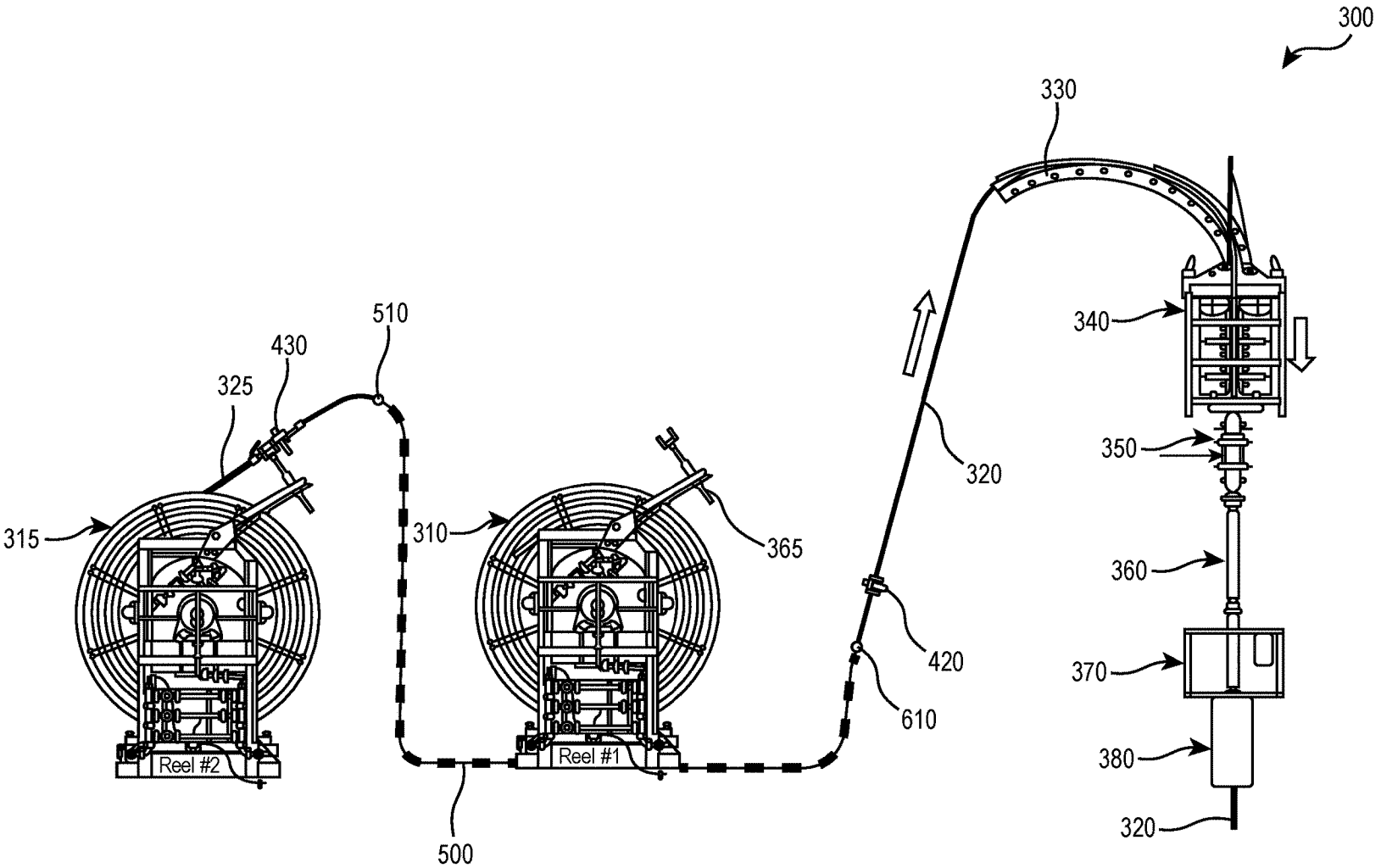

Turning to FIG. 6, the workflow 300 continues with the operator connecting the uphole end of the first coiled tubing string 320 to downhole end of the flexible stabbing snake 500. Accordingly, a first junction 610 is formed between the two. As shown, in one or more embodiments, the flexible s tabbing snake 500 may be coupled with the first working connector 440 (FIG. 4). Thus, in the illustrated embodiments, the flexible stabbing snake 500 is coupled to the uphole end of the first coiled tubing string 320 and the downhole end of the second coiled tubing string 325 uphole of the coiled tubing injector 340. Moreover, while the embodiment of FIGS. 5 and 6 have illustrated and described that the flexible stabbing snake 500 is coupled to the second coiled tubing string 325 prior to the first coiled tubing string 320, other embodiments may exist wherein the opposite is true. Accordingly, the present disclosure should not be limited to any specific order for the steps described in FIGS. 5 and 6.

Figure 7:
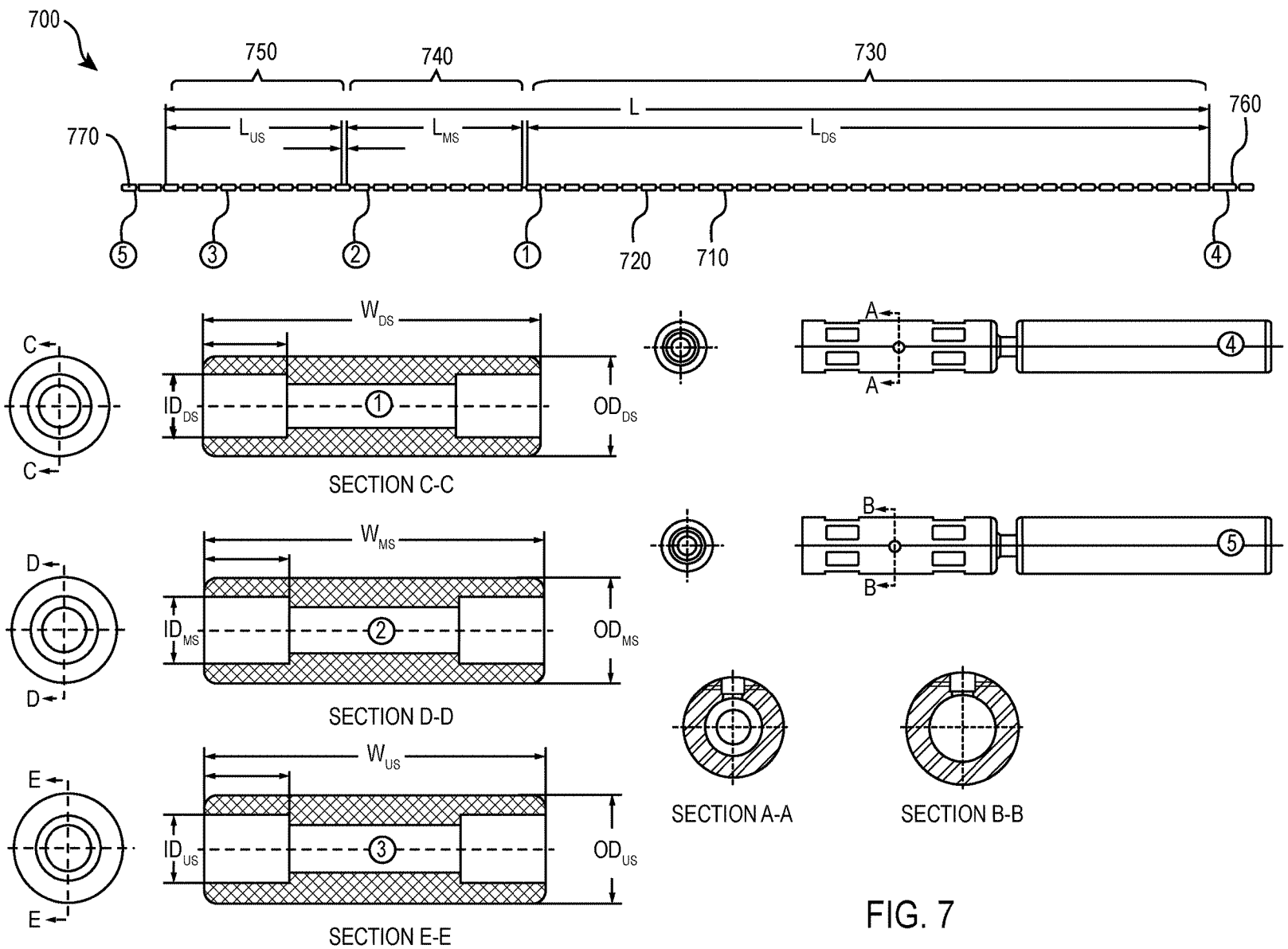

Turning to FIG. 7, illustrated are various different views of one example of a flexible stabbing snake 700 designed, manufactured, and used according to one or more embodiments of the disclosure. In the illustrated embodiment, the flexible stabbing snake 700 includes a conveyance 710 having a plurality of spaced apart ferrules/buttons 720 coupled thereto. The ferrules/buttons 720 are spaced to substantially mimic coiled tubing, for example as the coiled tubing passes through the coiled tubing injector 340. In at least one embodiment, the flexible stabbing snake 700 may have 10 or more spaced apart ferrules/buttons 720. In at least one other embodiment, the flexible stabbing snake 700 may have 20 or more spaced apart ferrules/buttons 720, and in yet another embodiment 30 or more. In one example, similar spacing is located between each of the ferrules/buttons 720. Accordingly, the flexible stabbing snake 700 having the conveyance 710 and ferrules/buttons 720 is able to provide a coupling between the first coiled tubing string 320 and the second coiled tubing string 325, but still be able to easily bend (e.g., around the coiled tubing guide arch 330) as needed.

The conveyance 710, in one or more examples, is braided wire. In yet another embodiment, the conveyance 710 is wire rope, among other possible conveyances. The conveyance 710 may vary in length (L) based upon the design of the coiled tubing surface equipment spread and downhole assembly. Nevertheless, in at least one or more examples, the conveyance 710 is at least 6 meters (e.g., about 20 feet) long. In one or more different examples, the conveyance 710 ranges from 9 meters to 18 meters (e.g., about 30 feet to about 60 feet) long, and in yet another example the conveyance 710 ranges from 13.7 meters to 16.8 meters (e.g., about 45 feet to about 55 feet) long. Additional lengths (L) could be accommodated if warranted. The ferrules/buttons 720 may be bonded to the conveyance 610 using metallic smelter, brazing and/or one or more different swaging/crimping processes, among other processes.

In at least one embodiment, the conveyance 710 has a downhole section 730, a middle section 740 and an uphole section 750. In this embodiment, the downhole section 730 has a length ($L_{DS}$), the middle section 740 has a length ($L_{MS}$), and the uphole section 750 has a length ($L_{US}$). In accordance with at least one embodiment, the length of the downhole section ($L_{DS}$) is at least two times a length of the middle section ($L_{MS}$) and a length of the uphole section ($L_{US}$). In accordance with at least one other embodiment, the length of the downhole section ($L_{DS}$) is at least four times a length of the middle section ($L_{MS}$) and a length of the uphole section ($L_{US}$). The larger length of the downhole section ($L_{DS}$), in theory, allows the first coiled tubing string 320 to be secured in the blowout preventer 380, and thus the flexible stabbing snake 700 is not being subjected to high loads prior to the middle section 740 and uphole section 750 entering the coiled tubing injector 340.

As shown in FIG. 7, the ferrules/buttons 720 in the downhole section 730 may have a downhole section outside diameter ($OD_{DS}$), the ferrules/buttons 720 in the middle section 740 may have middle section outside diameter ($OD_{MS}$), and the ferrules/buttons 720 in the uphole section 750 may have an uphole section outside diameter ($OD_{US}$). In at least one embodiment, one or all of the downhole section outside diameter ($OD_{DS}$), middle section outside diameter ($OD_{MS}$), and uphole section outside diameter ($OD_{US}$) are different from one or all of the others of the downhole section outside diameter ($OD_{DS}$), middle section outside diameter ($OD_{MS}$), and uphole section outside diameter ($OD_{US}$). For example, in one embodiment the middle section outside diameter ($OD_{MS}$) is greater than the downhole section outside diameter ($OD_{DS}$), and the uphole section outside diameter ($OD_{US}$) is greater than the middle section outside diameter ($OD_{MS}$). In yet another embodiment, the middle section outside diameter ($OD_{MS}$) is less than the downhole section outside diameter ($OD_{DS}$), and the uphole section outside diameter ($OD_{US}$) is less than the middle section outside diameter ($OD_{MS}$). Accordingly, the flexible stabbing snake 700 may provide a smooth transition between a smaller diameter first coiled tubing string 320 and a larger diameter second coiled tubing string 325, if that were the case, or alternatively between a larger diameter first coiled tubing string 320 and a smaller diameter second coiled tubing string 325, if that were the case. Nevertheless, other embodiments exist wherein the downhole section outside diameter ($OD_{DS}$), middle section outside diameter ($OD_{MS}$), and uphole section outside diameter ($OD_{US}$) are the same. The change in the downhole section outside diameter ($OD_{DS}$), middle section outside diameter ($OD_{MS}$), and uphole section outside diameter ($OD_{US}$) may be gradual, step-wise, or sudden. In one example, such as that shown in FIG. 7, the flexible stabbing snake 700 includes multiple step-wise changes in the outside diameter.

In at least one embodiment, the downhole section outside diameter ($OD_{DS}$), middle section outside diameter ($OD_{MS}$), and uphole section outside diameter ($OD_{US}$) relate to the first coiled tubing outside diameter ($D_{CTO1}$) and the second coiled tubing outside diameter ($D_{CTO2}$). For example, in at least one embodiment, the first coiled tubing string 320 has the first coiled tubing outside diameter ($D_{CTO1}$) and the second coiled tubing string 325 has a second greater coiled tubing outside diameter ($D_{CTO2}$), and further the first coiled tubing outside diameter ($D_{CTO1}$) is similar to the downhole section outside diameter ($OD_{DS}$) and the second greater coiled tubing outside diameter ($D_{CTO2}$) is similar to the uphole section outside diameter ($OD_{US}$).

As shown in FIG. 7, the ferrules/buttons 720 in the downhole section 730 may have a downhole section inside diameter ($ID_{DS}$), the ferrules/buttons 720 in the middle section 740 may have middle section inside diameter ($ID_{MS}$), and the ferrules/buttons 720 in the uphole section 750 may have an uphole section inside diameter ($ID_{US}$). In at least one embodiment, one or all of the downhole section inside diameter ($ID_{DS}$), middle section inside diameter ($ID_{MS}$), and uphole section inside diameter ($ID_{US}$) are the same as one another. In at least one other embodiment, one or all of the downhole section inside diameter ($ID_{DS}$), middle section inside diameter ($ID_{MS}$), and uphole section inside diameter ($ID_{US}$) are different from one another.

As shown in FIG. 7, the ferrules/buttons 720 in the downhole section 730 may have a downhole section width ($W_{DS}$), the ferrules/buttons 720 in the middle section 740 may have a middle section width ($W_{MS}$), and the ferrules/buttons 720 in the uphole section 750 may have an uphole section width ($W_{US}$). In at least one embodiment, the downhole section width ($W_{DS}$), the middle section width ($W_{MS}$), and the uphole section width ($W_{US}$) are the same as one another. In yet another embodiment, one or more of the downhole section width ($W_{DS}$), the middle section width ($W_{MS}$), and the uphole section width ($W_{US}$) are different from each other.

The flexible stabbing snake 700, in accordance with one or more examples of the disclosure, is pull tested up to 20,000 LBF @ 1.25 safety factor (25,000 LBF). The flexible stabbing snake 700, in accordance with one or more other examples of the disclosure, is pull tested up to 40,000 LBF @ 1.25 safety factor (50,000 LBF), and in yet another example pull tested up to 60,000 LBF @ 1.25 safety factor (75,000 LBF). Furthermore, a downhole swivel 760 located at the downhole end of the conveyance 710 and an uphole swivel 770 located at the uphole end of the conveyance 710, in at least one or more examples, is pressure tested up to 2,000 PSI @ 1.25 safety factor (2,500 PSI) after 1.5" 2.90#C.S. hydril thread and vent port process. In another example, the downhole swivel 760 located at the downhole end of the conveyance 710 and the uphole swivel 770 located at the uphole end of the conveyance 710, in at least one or more examples, is pressure tested up to 5,000 PSI @ 1.25 safety factor (6,250 PSI) after 1.5" 2.90# C.S. hydril thread and vent port process, and in yet another example pressure tested up to 10,000 PSI @ 1.25 safety factor (12,500 PSI) after 1.5" 2.90# C.S. hydril thread and vent port process. Thus, as shown, the flexible stabbing snake 700, including the conveyance 710 and the one or more spaced apart ferrules/buttons 720 has a fluid passageway extending entirely there through that acts as a fluid conduit, for example having the pressure test values set forth above.

Figure 8:
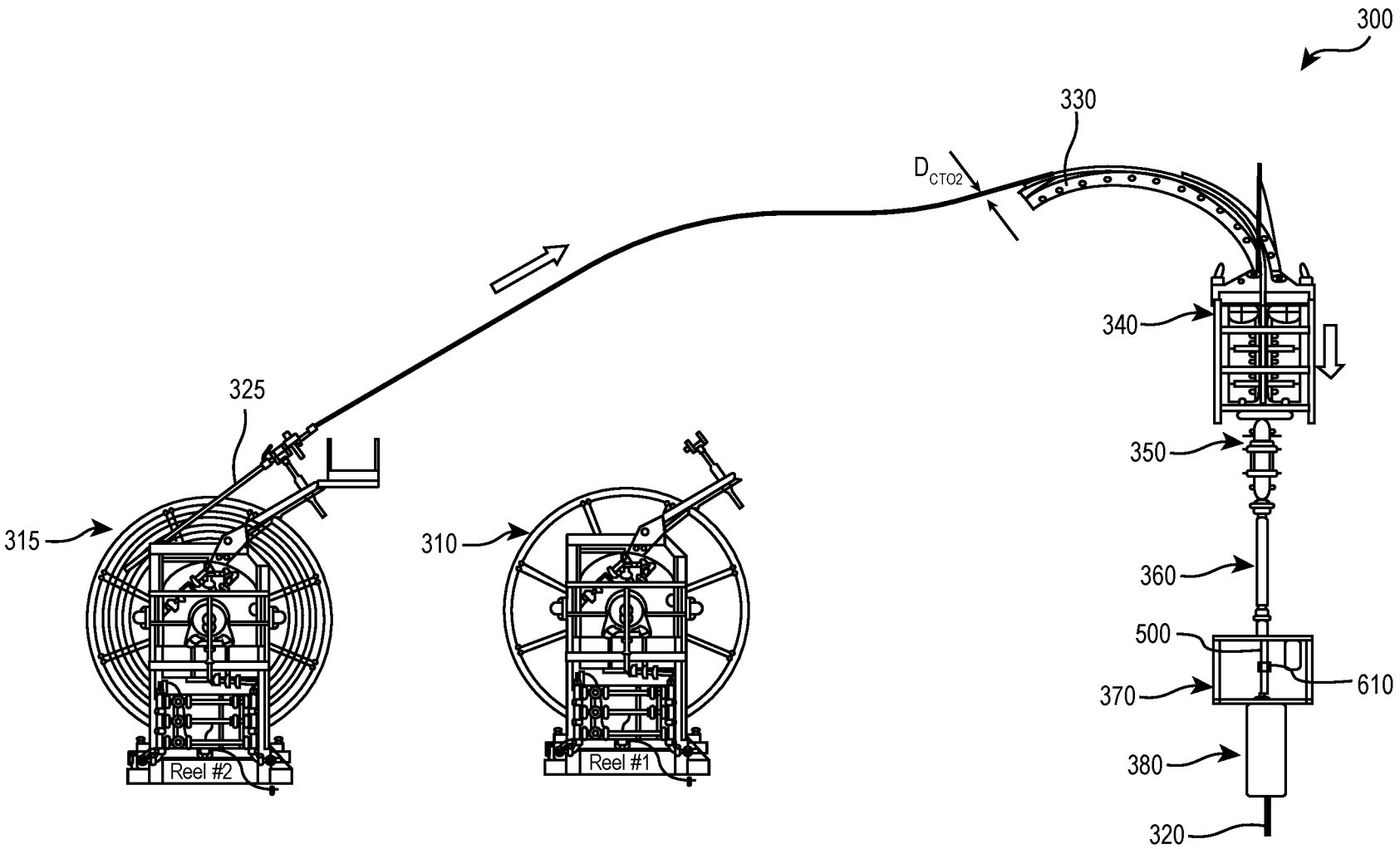

Turning to FIG. 8, the workflow 300 continues with the operator lowering the first coiled tubing string 320 downhole until the first junction 610 is between the coiled tubing injector 340 and the wellbore. In at least one embodiment, the first coiled tubing 320 is lowered downhole until the first junction 610 is in the work window 370. Thereafter, the operator would close slip/seal rams in the BOP 380, and then verify 0 psi, wherein the operator would then open the work window.

Figure 9:
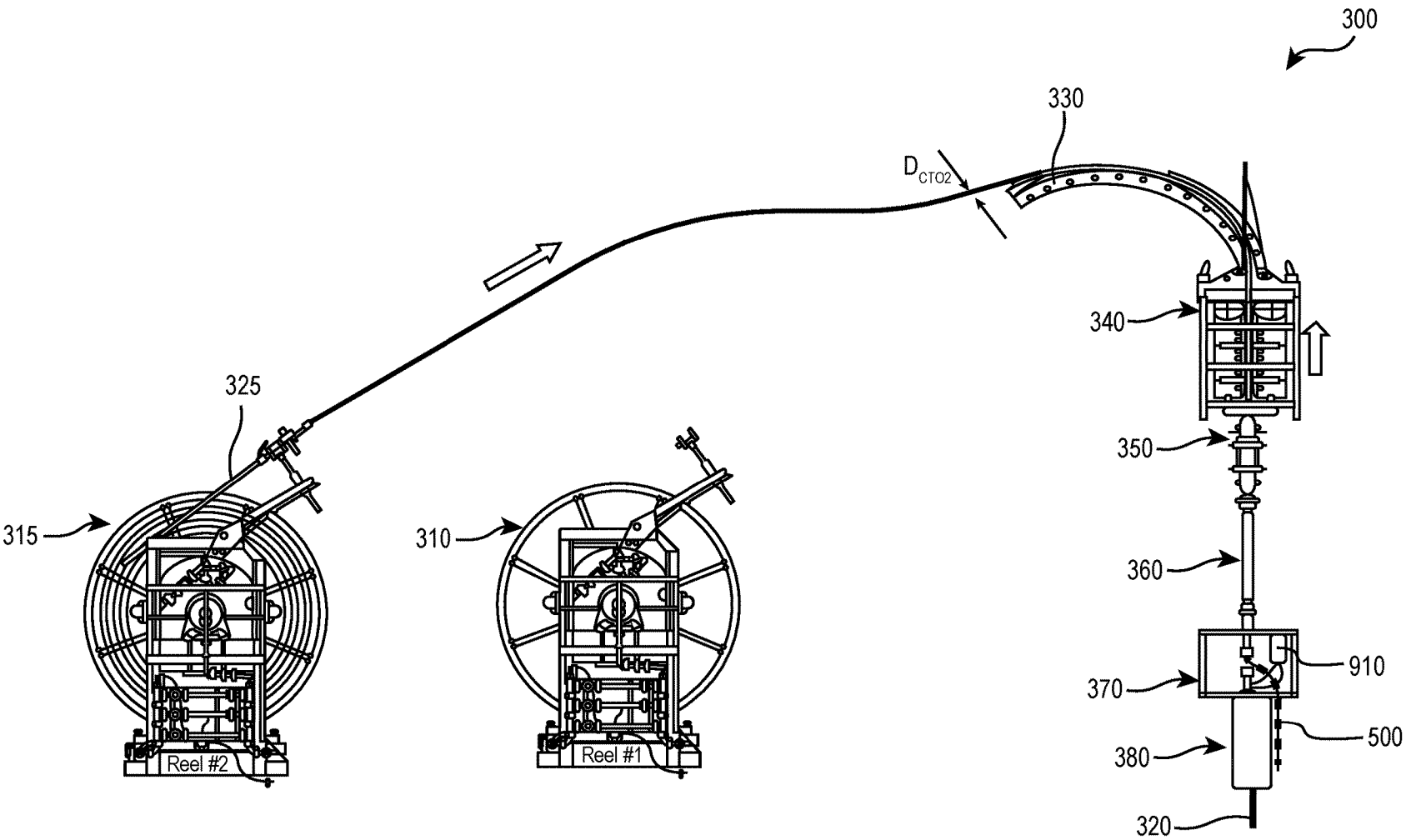

Turning to FIG. 9, the workflow 300 continues with the operator disconnecting the first junction 610 to expose the uphole end of the first coiled tubing string 320. FIG. 9 further illustrates that a safety device 910 may be coupled to the uphole end of the first coiled tubing string 320, to prevent the first coiled tubing string 320 from accidentally slipping through the BOP 380 and being lost in the wellbore.

Figure 10:
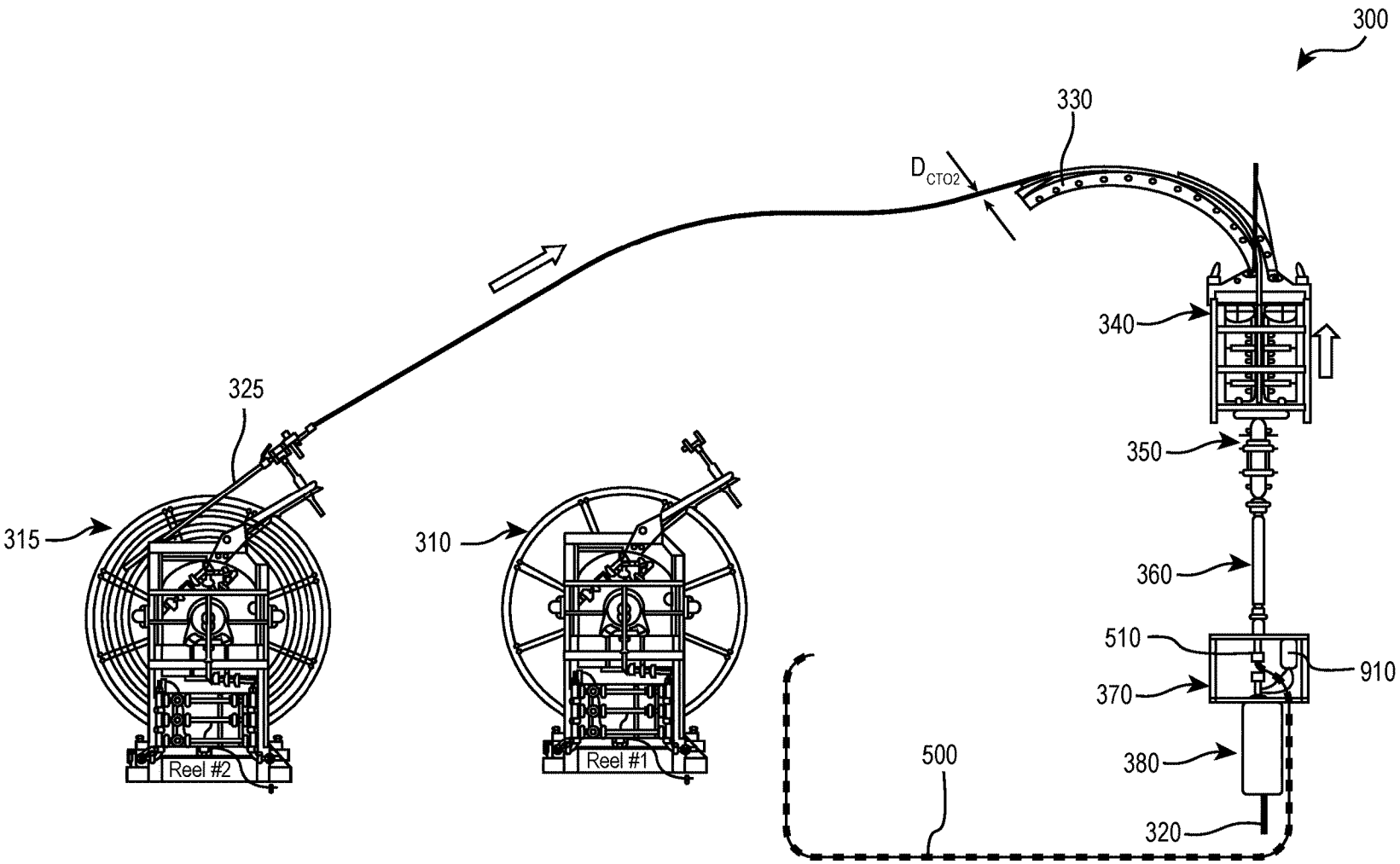

Turning to FIG. 10, the workflow 300 continues with the operator lowering the second coiled tubing string 325 until the second junction 510 is between the coiled tubing injector 340 and the wellbore. In the embodiment illustrated in FIG. 10, the second coiled tubing string 325 is lowered until the second junction 510 is in the work window 370.

Figure 11:
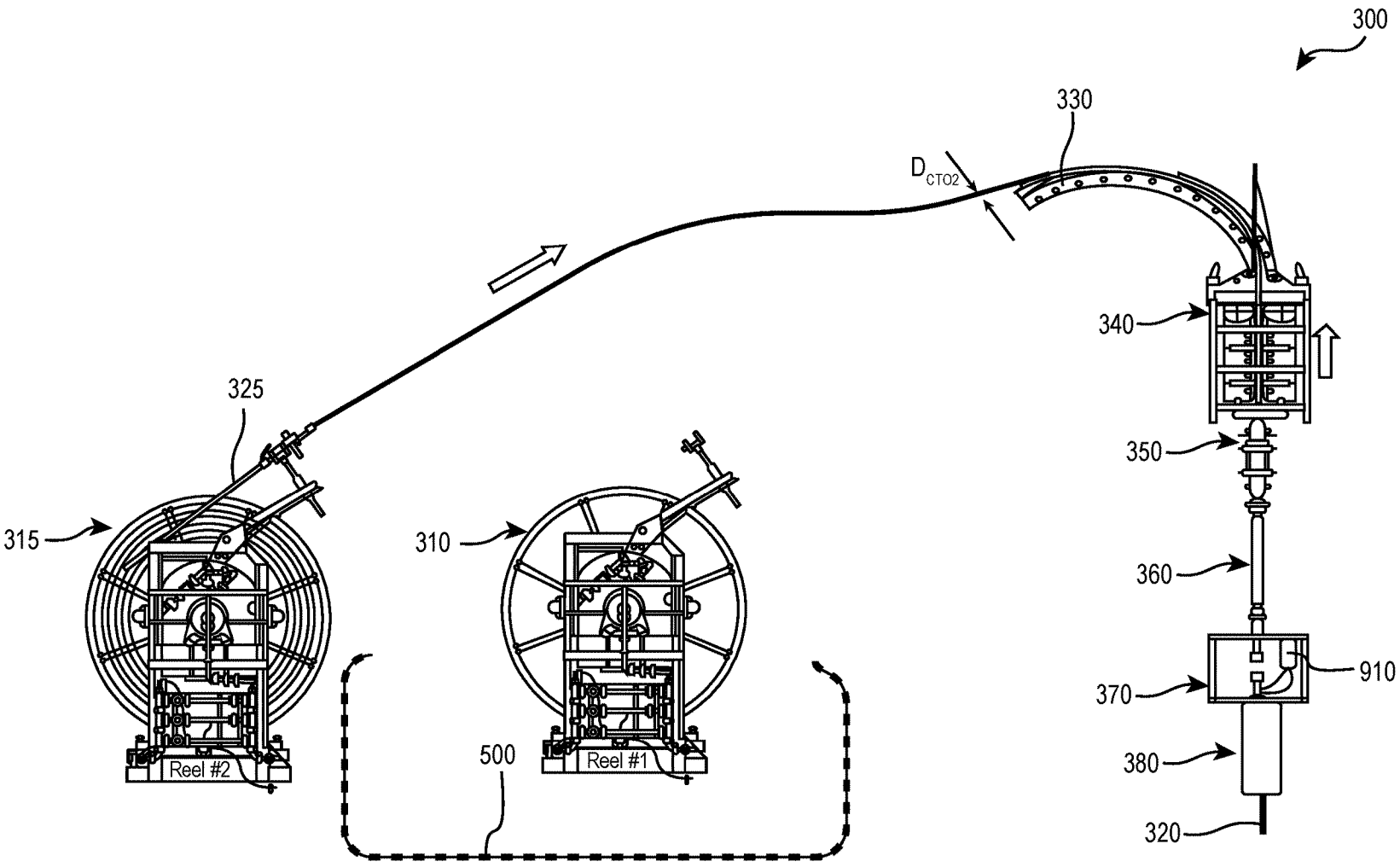

Turning to FIG. 11, the workflow 300 continues with the operator disconnecting the second junction 510 to expose the downhole end of the second coiled tubing string 325. At this stage, the flexible stabbing snake 500 is no longer coupled to either of the first coiled tubing string 320 or the second coiled tubing string 325. Moreover, the uphole end of the first coiled tubing string 320 is positioned proximate the downhole end of the second coiled tubing string 325, for example within the work window 370.

Figure 12:
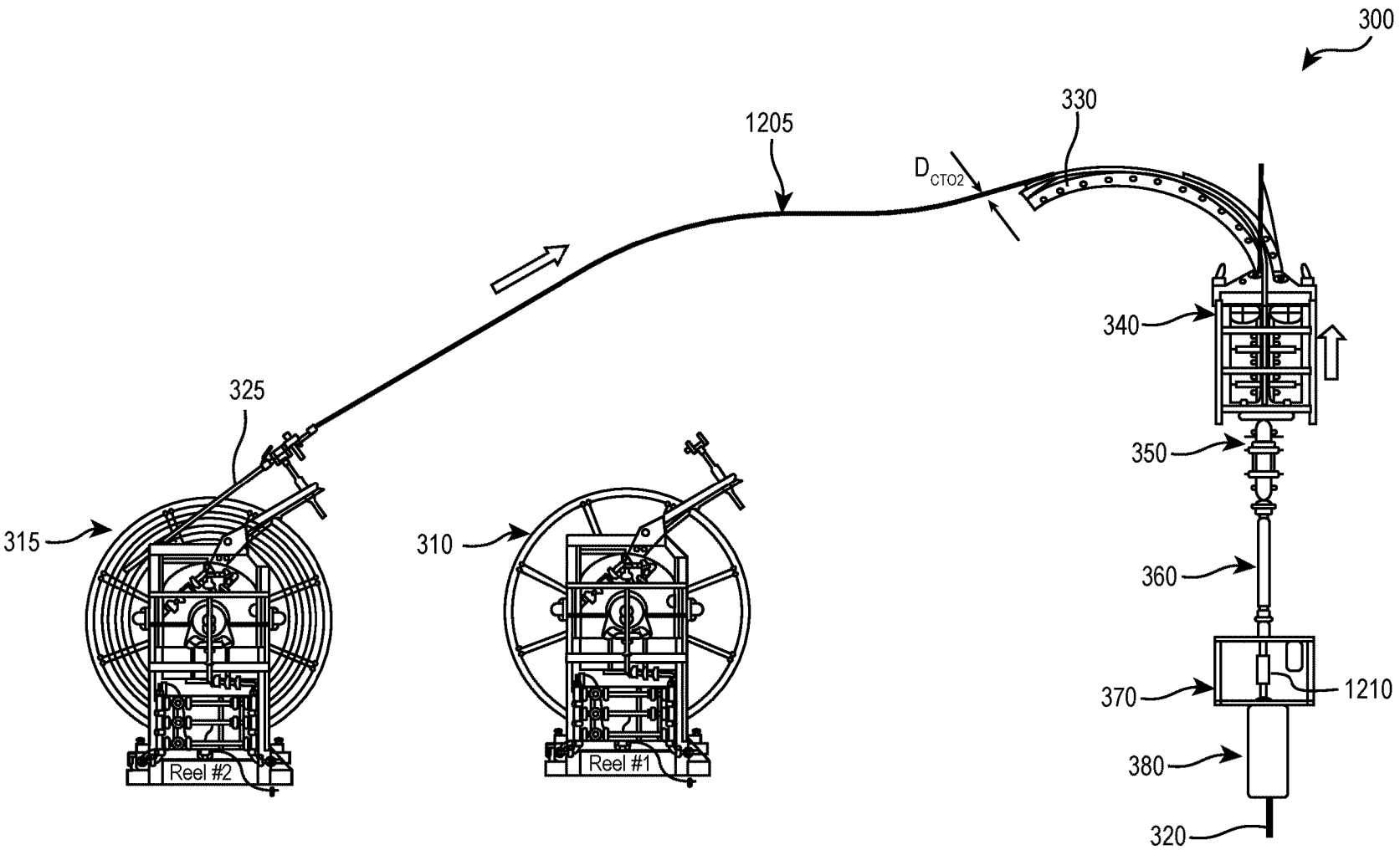

Turning to FIG. 12, the workflow continues with the operator coupling the uphole end of the first coiled tubing string 320 to the downhole end of a second coiled tubing string 325 at the location between the coiled tubing injector 340 and the wellbore to form the combined coiled tubing string 1205. In at least one embodiment, the uphole end of the first coiled tubing string 320 is coupled to the downhole end of a second coiled tubing string 325 in the work window 370. In the illustrated embodiment of FIG. 12, a working connector 1210 couples the first coiled tubing string 320 to the second coiled tubing string 325. While a specific working connector 1210 is illustrated herein, as the connection between the first coiled tubing string 320 and the second coiled tubing string 325 is being made below the coiled tubing injector 340, any known or hereafter discovered connector may be used.

Figure 12A:
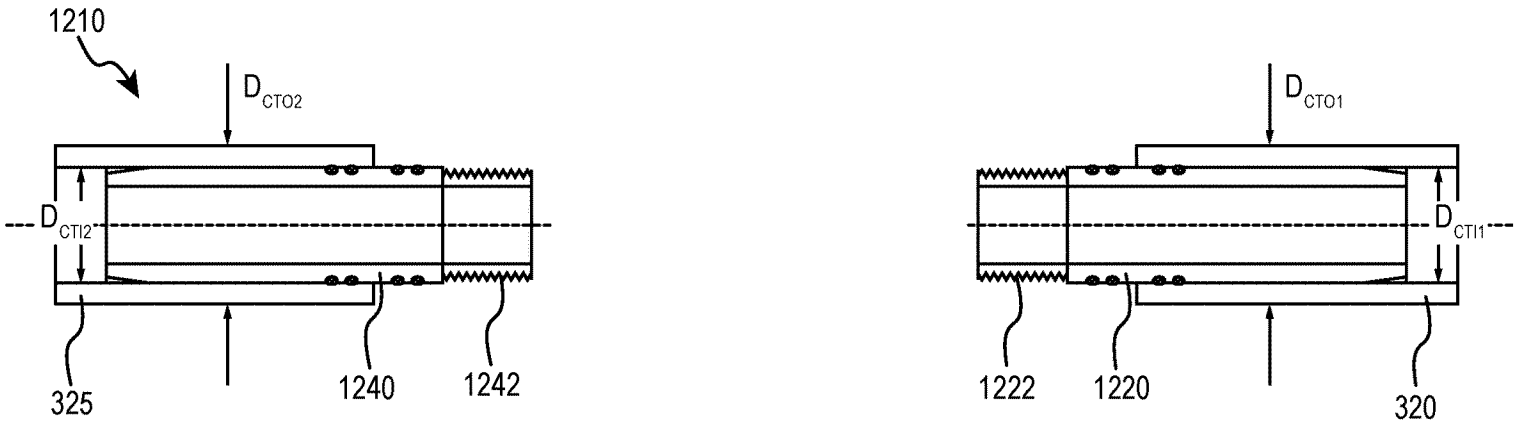

Turning briefly to FIG. 12A, with continued reference to FIG. 12, illustrated is one embodiment of portions of a working connector 1210 designed, manufactured and operated according to one or more embodiments of the disclosure. In the embodiment of FIG. 12A, the uphole end of the first coiled tubing string 320 and the downhole end of the second coiled tubing string 325 are positioned proximate one another. Further to this embodiment, the working connector 1210 at least partially includes a first coiled tubing connector insert 1220 positioned partially within the uphole end of the first coiled tubing string 320, and a second coiled tubing connector insert 1240 positioned partially within the downhole end of the second coiled tubing string 325. In the illustrated embodiment of FIG. 12A, the first coiled tubing connector insert 1220 and the second coiled tubing connector insert 1240 are dimpled connectors having one or more sealing elements disposed on an outer surface thereof.

Figure 12B:
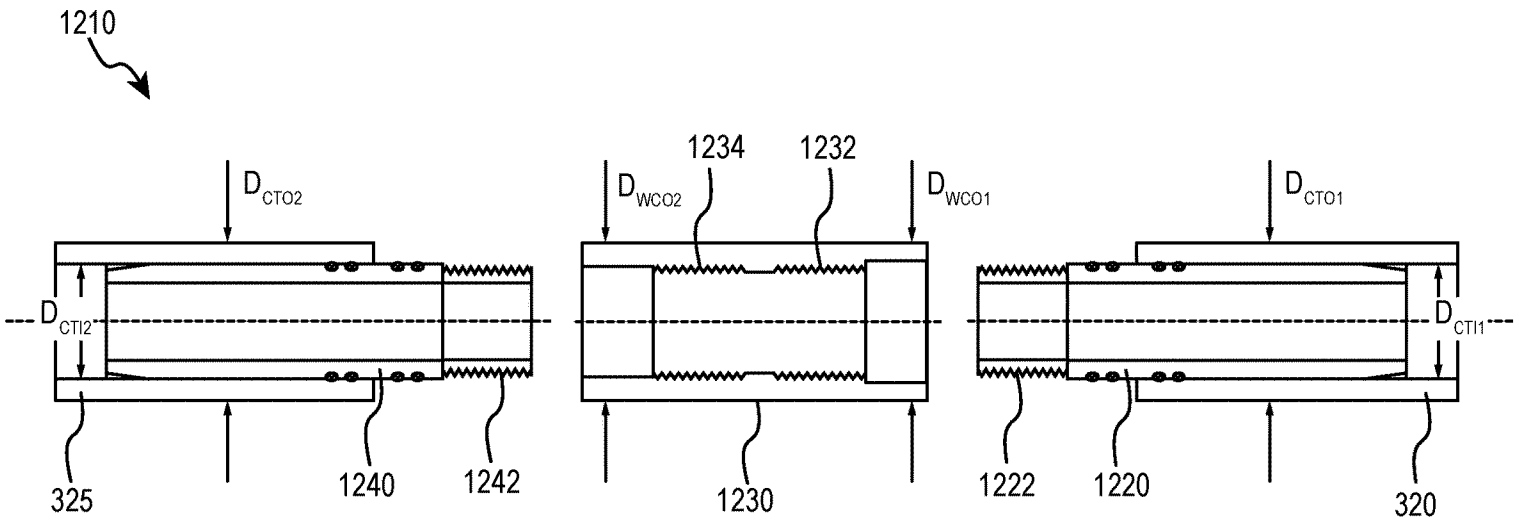

Turning to FIG. 12B, with continued reference to FIG. 12, illustrated is an unassembled working connector 1210. As shown, the working connector 1210 includes a connector nut 1230 configured to couple the first coiled tubing connector insert 1220 and the second coiled tubing connector insert 1240. In at least one embodiment, the connector nut 1230 has a first set of connector nut threads 1232 coupleable to a first set of connector insert threads 1222 of the first coiled tubing connector insert 1220, and a second set of connector nut threads 1234 coupleable to a second set of connector insert threads 1242 of the second coiled tubing connector insert 1240. In one embodiment of the disclosure, the first set of connector nut threads 1232 and the second set of connector nut threads 1234 are opposite handedness, such that as the connector nut 1230 is spun in a direction about the first and second coiled tubing connector inserts 1220, 1240 the first and second coiled tubing connector inserts 1220, 1240 are brought toward one another to form the combined coiled tubing string 1205, and vice-versa.

Figure 12C:
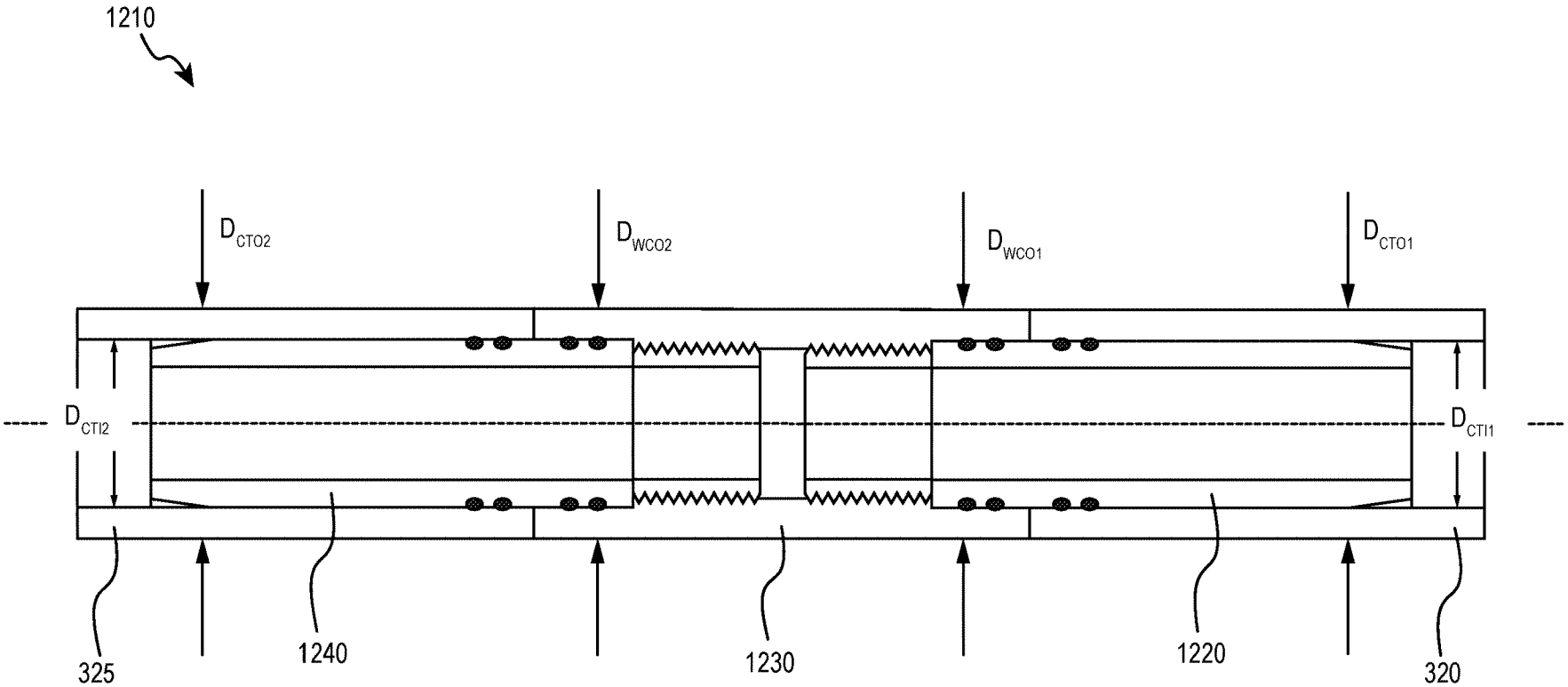

Turning to FIG. 12C, with continued reference to FIG. 12, illustrated is an assembled working connector 1210. In the illustrated embodiment of FIG. 12C, it is shown that the transition from the first coiled tubing string 320, to the connector nut 1230, and then to the second coiled tubing string 325 is smooth. In the illustrated embodiment, this is achieved, as the first coiled tubing string 320 has the first coiled tubing outside diameter ($D_{CTO1}$), the second coiled tubing string 325 has a second similar coiled tubing outside diameter ($D_{CTO2}$), and the working connector 1230 includes a first working connector outside diameter ($D_{WCO1}$) proximate the first coiled tubing string 320 and a second working connector outside diameter ($D_{CTO2}$) proximate the second coiled tubing string 325 that are both similar to the first coiled tubing outside diameter ($D_{CTO1}$) and the second similar coiled tubing outside diameter ($D_{CTO2}$). Notwithstanding the foregoing, other embodiments may exist wherein the connector nut 1230 could have a larger or smaller working connector outside diameter than the first coiled tubing string 320 and/or second coiled tubing string 325.

Figure 13:
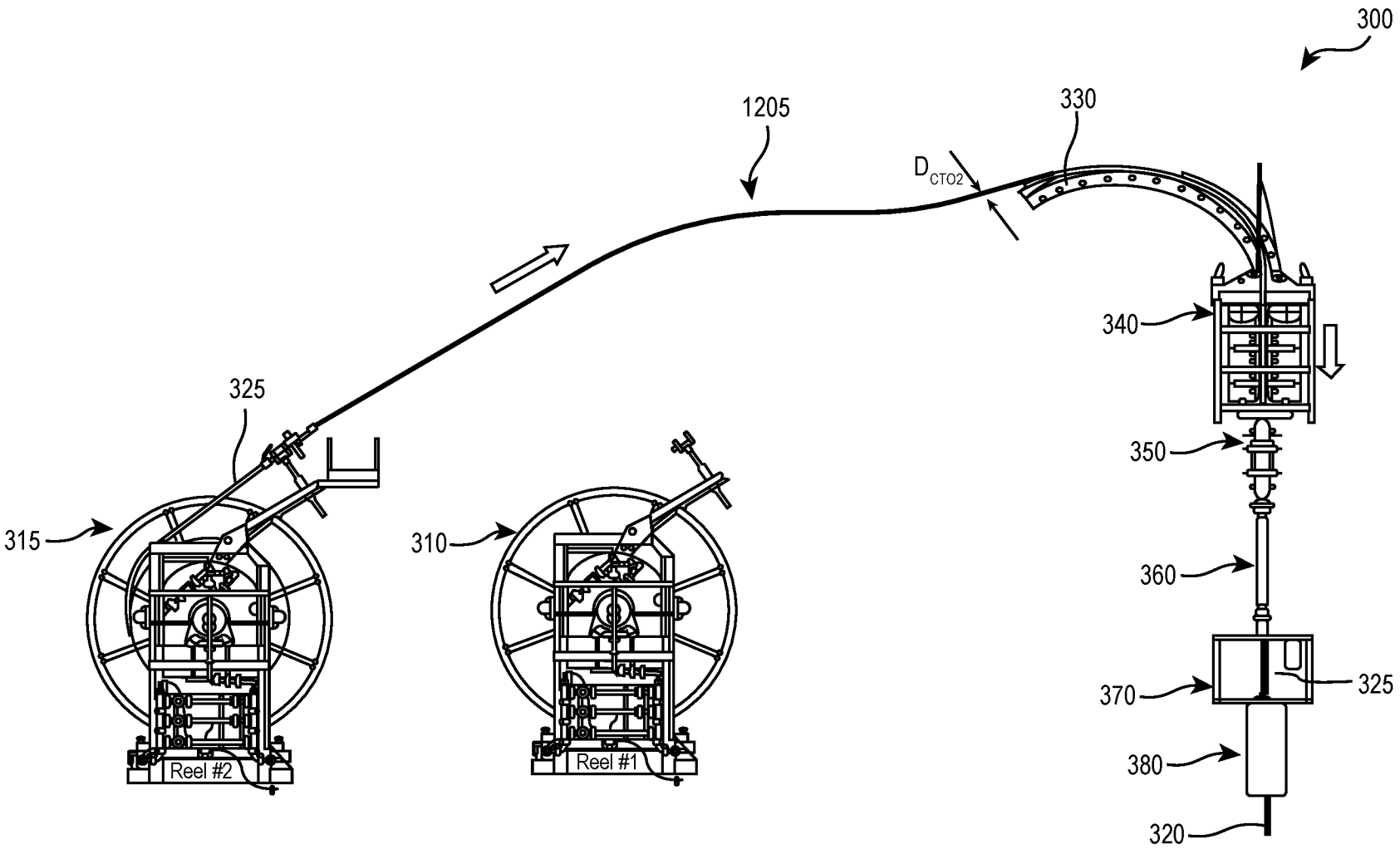

Turning to FIG. 13, the workflow 300 continues with the operator pressure and pull testing the working connector 1210. At this stage, the second coiled tubing string 325 has been coupled to the first coiled tubing string 320 downhole of the coiled tubing injector 340, and for example uphole of the blowout preventer 380. When the operator is confident that the working connector 1210 is appropriately connected, the operator would close the work window 370, open the blowout preventers 380, and then run the second coiled tubing string 325 into the wellbore to perform the intervention. At this stage, the combined coil tubing string 1205 is performing the intervention. The operator may incorporate centralizers/stand-offs to the combined coil tubing string 1205 for decreased wear of the first coiled tubing string 320, second coiled tubing string 325 or the working connector 1210 during intervention.

Figure 14:
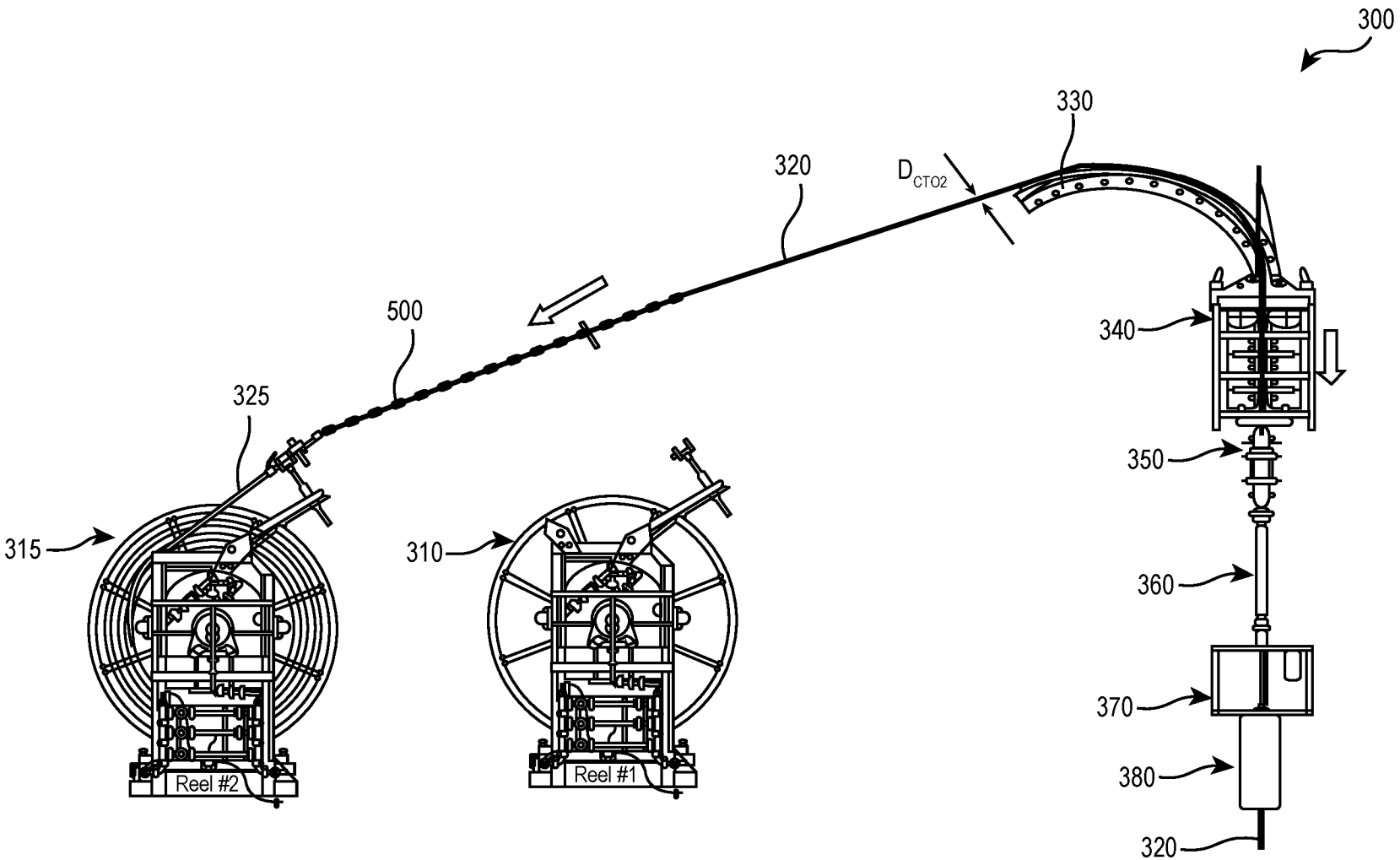

Turning to FIG. 14, when the intervention is complete, the workflow 300 could then perform the operations discussed and illustrated with respect to FIGS. 3 through 13, but in reverse order. For example, the workflow 300 could continue by pulling the combined coiled tubing string 1205 out of hole until the working connector 1210 is again located in the work window 370. The operator could then close the BOP 380 and bleed off the well pressure in the riser stack and combined coiled tubing string 1205. The operator could then open the work window 370, and disconnect the working connector 1210. The operator could then connect the downhole end of a second coiled tubing string 325 to the uphole end of the flexible stabbing snake 500 to reform the second junction 510, and then pull the second coiled tubing string 325 having the flexible stabbing snake 500 coupled thereto until the downhole end of the flexible stabbing snake 500 is proximate the uphole end of the first coiled tubing string 320. The operator could then connect the uphole end of the first coiled tubing string 320 to the downhole end of the flexible stabbing snake 500 to reform the first junction 610. The operator could then open the BOP 380 and pull the second coiled tubing string 325, flexible stabbing snake 500 and first coiled tubing string 320 uphole until the uphole end of the first coiled tubing string 320 is once again proximate the first coiled tubing reel 310, wherein the flexible stabbing snake 500 is disconnected from both the first and second coiled tubing strings 320, 325, as shown in FIG. 16.

Aspects disclosed herein include:

A. A method for connecting coiled tubing strings, the method including: 1) lowering a downhole end of a first coiled tubing string within a wellbore; 2) coupling an uphole end of the first coiled tubing string to a downhole end of a second coiled tubing string at a location between a coiled tubing injector and the wellbore to form a combined coiled tubing string; and 3) lowering the combined coiled tubing string within the wellbore.

B. A flexible stabbing snake, the flexible snake including: 1) a conveyance having a downhole end configured to couple to a first coiled tubing string and an uphole end configured to couple to a second coiled tubing string; and 2) 10 or more spaced apart ferrules/buttons coupled to the conveyance.

Aspects A and B may have one or more of the following additional elements in combination: Element 1: further including disconnecting the uphole end of the first coiled tubing string from a first coiled tubing reel, connecting a disconnected uphole end of the first coiled tubing string to a downhole end of a flexible stabbing snake to form a first junction, and connecting the downhole end of a second coiled tubing string to an uphole end of the flexible stabbing snake to form a second junction. Element 2: wherein the connecting occurs uphole of the coiled tubing injector and prior to the coupling the uphole end of the first coiled tubing string to the downhole end of the second coiled tubing string. Element 3: further including: 1) lowering the first coiled tubing string downhole until the first junction is between the coiled tubing injector and the wellbore; then 2) disconnecting the first junction to expose the uphole end of the first coiled tubing string; then 3) lowering the second coiled tubing string until the second junction is between the coiled tubing injector and the wellbore; then 4) disconnecting the second junction to expose the downhole end of the second coiled tubing string; and then 5) coupling the uphole end of the first coiled tubing string to the downhole end of a second coiled tubing string at the location between the coiled tubing injector and the wellbore to form the combined coiled tubing string. Element 14: wherein the flexible stabbing snake includes a conveyance having a plurality of spaced apart ferrules/buttons coupled thereto. Element 5: wherein the conveyance is a braided wire conveyance having 10 or more spaced apart ferrules/buttons coupled thereto. Element 6: wherein the flexible stabbing snake includes a downhole swivel located at the downhole end of the conveyance and an uphole swivel located at the uphole end of the conveyance. Element 7: wherein the conveyance has a downhole section, a middle section and an uphole section, and further wherein the ferrules/buttons in the downhole section have a downhole section outside diameter ($OD_{DS}$), the ferrules/buttons in the middle section have a middle section outside diameter ($OD_{MS}$) greater than the downhole section outside diameter ($OD_{DS}$), and the ferrules/buttons in the uphole section have an uphole section outside diameter ($OD_{US}$) greater than the middle section outside diameter ($OD_{MS}$). Element 8: wherein the first coiled tubing string has a first coiled tubing outside diameter ($D_{CTO1}$) and the second coiled tubing string has a second greater coiled tubing outside diameter ($D_{CTO2}$), and further wherein the first coiled tubing outside diameter ($D_{CTO1}$) is similar to the downhole section outside diameter ($OD_{DS}$) and the second greater coiled tubing outside diameter ($D_{CTO2}$) is similar to the uphole section outside diameter ($OD_{US}$). Element 9: wherein a length of the conveyance (L) is at least 6 meters. Element 10: wherein a length of the conveyance (L) ranges from 9 meters to 18 meters. Element 11: wherein a length of the downhole section ($L_{DS}$) is at least two times a length of the middle section ($L_{MS}$) and a length of the uphole section ($L_{US}$). Element 12: wherein the location is within a work window. Element 13: wherein further including disconnecting the uphole end of the first coiled tubing string from a first coiled tubing reel, connecting a disconnected uphole end of the first coiled tubing string to a downhole end of a flexible stabbing snake to form a first junction, and connecting the downhole end of a second coiled tubing string to an uphole end of the flexible stabbing snake to form a second junction, wherein the disconnecting and connecting occur uphole of the coiled tubing injector and prior to the coupling the uphole end of the first coiled tubing string to the downhole end of the second coiled tubing string, and further including: 2) lowering the first coiled tubing string downhole until the first junction is in the work window; then 2) disconnecting the first junction to expose the uphole end of the first coiled tubing string; then 3) lowering the second coiled tubing string until the second junction is in the work window; then 4) disconnecting the second junction to expose the downhole end of the second coiled tubing string; and then 5) coupling the uphole end of the first coiled tubing string to the downhole end of a second coiled tubing string in the work window to form the combined coiled tubing string. Element 14: wherein the conveyance has a downhole section, a middle section and an uphole section, and further wherein the ferrules/buttons in the downhole section have a downhole section outside diameter ($OD_{DS}$), the ferrules/buttons in the middle section have a middle section outside diameter ($OD_{MS}$) greater than the downhole section outside diameter ($OD_{DS}$), and the ferrules/buttons in the uphole section have an uphole section outside diameter ($OD_{US}$) greater than the middle section outside diameter ($OD_{MS}$). Element 15: wherein the downhole section outside diameter ($OD_{DS}$) is similar to a first coiled tubing outside diameter ($D_{CTO1}$) of the first coiled tubing string that the flexible stabbing snake is configured to couple, and the uphole section outside diameter ($OD_{US}$) is similar to a second greater coiled tubing outside diameter ($D_{CTO2}$) of the second coiled tubing string that the flexible stabbing snake is configured to couple. Element 16: wherein a length of the downhole section ($L_{DS}$) is at least two times a length of the middle section ($L_{MS}$) and a length of the uphole section ($L_{US}$). Element 17: wherein a length of the conveyance (L) ranges from 9 meters to 18 meters. Element 18: wherein the conveyance is a braided wire conveyance, and further wherein a downhole swivel is located at the downhole end of the conveyance and an uphole swivel is located at the uphole end of the conveyance. Element 19: wherein the conveyance has a length (L) of at least 6 meters.

Those skilled in the art to which this application relates will appreciate that other and further additions, deletions, substitutions and modifications may be made to the described examples.

What is claimed is:

1. A method for connecting coiled tubing strings, comprising:

lowering a downhole end of a first coiled tubing string through a coiled tubing injector and within a wellbore;

disconnecting an uphole end of the first coiled tubing string from a first coiled tubing reel;

connecting the uphole end of the first coiled tubing string to a downhole end of a flexible stabbing snake to form a first junction and a downhole end of a second coiled tubing string located on a second coiled tubing reel to an uphole end of the flexible stabbing snake to form a second junction, the first junction being formed between the first coiled tubing reel and the coiled tubing injector and the second junction being formed between the second coiled tubing reel and the coiled tubing injector;

passing the stabbing snake with the first junction and the second junction through the coiled tubing injector;

disconnecting the first junction and the second junction and then coupling the uphole end of the first coiled tubing string to the downhole end of the second coiled tubing string at a location between the coiled tubing injector and the wellbore to form a combined coiled tubing string; and lowering the combined coiled tubing string within the wellbore.

2. The method as recited in claim 1, further including:

lowering the first coiled tubing string downhole until the first junction is between the coiled tubing injector and the wellbore; then disconnecting the first junction to expose the uphole end of the first coiled tubing string; then lowering the second coiled tubing string until the second junction is between the coiled tubing injector and the wellbore; then disconnecting the second junction to expose the downhole end of the second coiled tubing string; and then coupling the uphole end of the first coiled tubing string to the downhole end of the second coiled tubing string at the location between the coiled tubing injector and the wellbore to form the combined coiled tubing string.

3. The method as recited in claim 1, wherein the flexible stabbing snake includes a conveyance having a plurality of spaced apart ferrules/buttons coupled thereto.

4. The method as recited in claim 3, wherein the conveyance is a braided wire conveyance having 10 or more spaced apart ferrules/buttons coupled thereto.

5. The method as recited in claim 3, wherein the flexible stabbing snake includes a downhole swivel located at the downhole end of the conveyance and an uphole swivel located at the uphole end of the conveyance.

6. The method as recited in claim 3, wherein the conveyance has a downhole section, a middle section and an uphole section, and further wherein the ferrules/buttons in the downhole section have a downhole section outside diameter ($OD_{DS}$), the ferrules/buttons in the middle section have a middle section outside diameter ($OD_{MS}$) greater than the downhole section outside diameter ($OD_{DS}$), and the ferrules/buttons in the uphole section have an uphole section outside diameter ($OD_{US}$) greater than the middle section outside diameter ($OD_{MS}$).

7. The method as recited in claim 6, wherein the first coiled tubing string has a first coiled tubing outside diameter ($D_{CTO1}$) and the second coiled tubing string has a second greater coiled tubing outside diameter ($D_{CTO2}$), and further wherein the first coiled tubing outside diameter ($D_{CTO1}$) is similar to the downhole section outside diameter ($OD_{DS}$) and the second greater coiled tubing outside diameter ($D_{CTO2}$) is similar to the uphole section outside diameter ($OD_{US}$).

8. The method as recited in claim 6, wherein a length of the conveyance (L) is at least 6 meters.

9. The method as recited in claim 6, wherein a length of the conveyance (L) ranges from 9 meters to 18 meters.

10. The method as recited in claim 6, wherein a length of the downhole section ($L_{DS}$) is at least two times a length of the middle section ($L_{MS}$) and a length of the uphole section ($L_{US}$).

11. The method as recited in claim 1, wherein the location is within a work window.

12. The method as recited in claim 11, further including disconnecting the uphole end of the first coiled tubing string from the first coiled tubing reel, connecting a disconnected uphole end of the first coiled tubing string to the downhole end of the flexible stabbing snake to form the first junction, and connecting the downhole end of the second coiled tubing string to the uphole end of the flexible stabbing snake to form the second junction, wherein the disconnecting and connecting occur uphole of the coiled tubing injector and prior to the coupling the uphole end of the first coiled tubing string to the downhole end of the second coiled tubing string, and further including:

lowering the first coiled tubing string downhole until the first junction is in the work window; then disconnecting the first junction to expose the uphole end of the first coiled tubing string; then lowering the second coiled tubing string until the second junction is in the work window; then disconnecting the second junction to expose the downhole end of the second coiled tubing string; and then coupling the uphole end of the first coiled tubing string to the downhole end of the second coiled tubing string in the work window to form the combined coiled tubing string.

13. The method of claim 1, wherein the disconnecting the uphole end of the first coiled tubing string from the first coiled tubing reel, the connecting the uphole end of the first coiled tubing string to the downhole end of the flexible stabbing snake, the connecting the downhole end of the second coiled tubing string to the uphole end of the flexible stabbing snake, and the disconnecting the first junction and the second junction all occur without rigging down the coiled tubing injector.

14. A flexible stabbing snake, comprising:

a conveyance having a downhole end configured to couple to a first coiled tubing string and an uphole end configured to couple to a second coiled tubing string; and 10 or more spaced apart ferrules/buttons coupled to the conveyance, wherein the conveyance has a downhole section and an uphole section, and further wherein the downhole section has a downhole section outside diameter ($OD_{DS}$) similar to a first coiled tubing outside diameter ($D_{CTO1}$) of the first coiled tubing string that the flexible stabbing snake is configured to couple, and the uphole section has an uphole section outside diameter ($OD_{US}$) similar to a second coiled tubing outside diameter ($D_{CTO2}$) of the second coiled tubing string that the flexible stabbing snake is configured to couple, the 10 or more spaced apart ferrules/buttons and the conveyance configured to pass through a coiled tubing injector.

15. The flexible stabbing snake as recited in claim 14, wherein the conveyance has the downhole section, a middle section and the uphole section, and further wherein the ferrules/buttons in the middle section have a middle section outside diameter ($OD_{MS}$) greater than the downhole section outside diameter ($OD_{DS}$) and less than the uphole section outside diameter ($OD_{US}$).

16. The flexible stabbing snake as recited in claim 15, wherein a length of the downhole section ($L_{DS}$) is at least two times a length of the middle section ($L_{MS}$) and a length of the uphole section ($L_{US}$).

17. The flexible stabbing snake as recited in claim 14, wherein a length of the conveyance (L) ranges from 9 meters to 18 meters.

18. The flexible stabbing snake as recited in claim 14, wherein the conveyance is a braided wire conveyance, and further wherein a downhole swivel is located at the downhole end of the conveyance and an uphole swivel is located at the uphole end of the conveyance.

19. The flexible stabbing snake as recited in claim 14, wherein the conveyance has a length (L) of at least 6 meters.

* * * * *